US009527642B2

(12) United States Patent
Ramsuer et al.

(10) Patent No.: US 9,527,642 B2
(45) Date of Patent: Dec. 27, 2016

(54) CARTON AND CARTON BLANK

(71) Applicant: WestRock Packaging Systems, LLC, Norcross, GA (US)

(72) Inventors: Brandon L. Ramsuer, Henrico, VA (US); Nathaniel B. Ball, Richmond, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 14/891,866

(22) PCT Filed: May 16, 2014

(86) PCT No.: PCT/US2014/038321
§ 371 (c)(1),
(2) Date: Nov. 17, 2015

(87) PCT Pub. No.: WO2014/189778
PCT Pub. Date: Nov. 27, 2014

(65) Prior Publication Data

US 2016/0083159 A1 Mar. 24, 2016

Related U.S. Application Data

(60) Provisional application No. 61/827,505, filed on May 24, 2013, provisional application No. 61/903,595, filed on Nov. 13, 2013.

(51) Int. Cl.
*B65D 5/54* (2006.01)
*B65D 71/36* (2006.01)

(52) U.S. Cl.
CPC ..... *B65D 71/36* (2013.01); *B65D 5/541* (2013.01); *B65D 5/542* (2013.01);
(Continued)

(58) Field of Classification Search
None
See application file for complete search history.

(56) References Cited

U.S. PATENT DOCUMENTS 3,829,006 A * 8/1974 Spiegel ..... B65D 5/542 229/237
4,318,474 A * 3/1982 Hasegawa ..... B65D 5/542 206/199

(Continued)

FOREIGN PATENT DOCUMENTS

WO 2006/050316 5/2006
WO 2013/138264 9/2013

*Primary Examiner* — Gary Elkins
(74) *Attorney, Agent, or Firm* — WestRock Intellectual Property Group

(57) ABSTRACT

A carton (90) for packaging one of more articles (A) comprising a plurality of walls including a top wall (16), a first side wall (14), a second side wall (18), a first end wall (22*a*, 24*a*, 26*a*, 28*a*), a second end wall (2*b*, 24*b*, 26*b*, 28*b*) and a bottom wall (12), the carton having an access device (D) for accessing said one or more articles, the access device comprising a plurality of primary lines of severance (36*a*, 34*a*, 32*a*, 30*a*, 36*b*, 34*b*, 32*b*, 30*b*) which are defined in the first side wall, the second side wall, the first end wall and the top wall so as to define a detachable corner (C) of the carton, wherein the access device comprises a fold line (40) extending transversely across the top wall for enabling folding of the detachable corner when in a partially detached condition.

17 Claims, 25 Drawing Sheets

(52) U.S. Cl.
CPC ..... *B65D 2571/0045* (2013.01); *B65D 2571/0058* (2013.01); *B65D 2571/0066* (2013.01); *B65D 2571/00141* (2013.01); *B65D 2571/00728* (2013.01)

(56) References Cited

U.S. PATENT DOCUMENTS

| | | | | |
|---|---|---|---|---|
| 4,946,042 | A * | 8/1990 | Ferreri | B65D 5/5405 229/241 |
| 6,435,351 | B1 * | 8/2002 | Gibb | B65D 5/542 206/736 |
| 7,328,798 | B2 * | 2/2008 | Auclair | B65D 71/36 206/427 |
| 7,673,789 | B2 * | 3/2010 | DeBusk | B65D 71/36 206/427 |
| 7,699,213 | B2 * | 4/2010 | DeBusk | B65D 71/36 229/122 |
| 7,743,968 | B2 * | 6/2010 | Theelen | B65D 71/36 229/117.13 |
| 2004/0060972 | A1 | 4/2004 | Harrelson | |
| 2006/0091193 | A1 | 5/2006 | Debusk | |
| 2007/0017966 | A1 | 1/2007 | Debusk | |
| 2007/0029220 | A1 | 2/2007 | Bradford | |
| 2010/0276333 | A1 | 11/2010 | Couture | |
| 2011/0030321 | A1 | 2/2011 | Brand | |

* cited by examiner

CARTON AND CARTON BLANK

REFERENCE TO RELATED APPLICATIONS

This application is a National Phase application of PCT Application No. PCT/US2014/03821, filed May 16, 2014, which claims the benefit of U.S. Provisional Patent Application Nos. 61/827,505, and 61/903,595, filed May 24, 2013 and Nov. 13, 2013, respectively, each of which is incorporated herein by reference in its entirety.

FIELD OF THE INVENTION

The present invention relates to a carton and to a blank for forming a carton more specifically, but not exclusively, to a carton having a dispenser for accessing the contents of the carton.

BACKGROUND OF THE INVENTION

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide multi-packs with features such as, but not limited to, dispensers or access means. These features often require a portion of the carton to be torn or separated from another portion of the carton. The present invention is concerned with providing a dispenser which can be readily removed by a user.

The present invention seeks to overcome or at least mitigate the problems of the prior art.

SUMMARY OF INVENTION

According to a first aspect of the present invention, there is provided a carton for packaging one or more articles comprising a plurality of walls including a top wall, a first side wall, a second side wall, a first end wall, a second end wall and a bottom wall, the carton having an access device for accessing said one or more articles, the access device comprising a plurality of primary lines of severance which are defined in the first side wall, the second side wall, the first end wall and the top wall so as to define a detachable corner of the carton, wherein the access device comprises a fold line extending transversely across the top wall for enabling folding of the detachable corner when in a partially detached condition.

Preferably, the fold line is linear in shape.

Alternatively, the fold line is arcuate in shape so as to bow the top wall outwardly such that the top wall is concave when viewed from inside the carton, thereby creating a void into which a user may insert one or more fingers.

In some embodiments, the access device comprises a first minor line of severance defined in the first side wall extending from a first end of the fold line generally towards at least one of the primary lines of severance in the first side wall and a second minor line of severance defined in the second side wall extending from a second end of the fold line generally towards at least one of the primary lines of severance in the second side wall, the first and second minor lines of severance being arranged contiguously with the fold line.

Alternatively, the detachable corner is formed in part from a first portion of the top wall; the fold line transversely extends entirely across the first portion of the top wall for enabling folding of the first portion when the detachable corner is partially detached from the carton.

Preferably, the access device comprises a first minor line of severance defined in the first side wall extending from a first end of the fold line generally towards at least one of the primary lines of severance in the first side wall, and a second minor line of severance defined in the second side wall extending from a second end of the fold line generally towards at least one of the primary lines of severance in the second side wall, the first and second minor lines of severance being arranged contiguously with the fold line.

According to a second aspect of the present invention there is provided a carton for packaging one or more articles comprising a plurality of walls including a top wall, a first side wall, a second side wall, a first end wall, a second end wall and a bottom wall, the carton having an access device for accessing said one or more articles, the access device comprising a plurality of primary lines of severance which are defined in the first side wall, the second side wall, the first end wall and the top wall so as to define a detachable corner of the carton, wherein the access device comprises at least one aperture which separates at least two of the primary lines of severance to control tearing of the primary lines of severance.

Preferably, said at least one aperture is substantially oval in shape.

Preferably, said at least one aperture is substantially oval in shape, the aperture having a longitudinal axis which is substantially aligned with at least two of the primary lines of severance.

In some embodiments, said at least one aperture is substantially oval in shape, the aperture having a longitudinal axis between a first end of said at least one aperture and a second end of said at least one aperture wherein at least two of the primary lines of severance extend from the first end in a first direction and from the second end in a second direction.

Optionally, the access device comprises a minor line of severance which extends from a side edge of the at least one aperture in a third direction.

Alternatively, the access device comprises a tear initiation device for facilitating initiation of a tear developing along the primary lines of severance for removal of the corner portion; the primary lines of severance include a tear completion point where the tear stops developing when the corner portion is fully separated from the carton, and the at least one aperture is located along the primary lines of severance between the tear initiation device and the tear completion point, the at least one aperture being spaced apart from either one of the tear initiation device and the tear completion point.

Alternatively, said at least one aperture is substantially triangular in shape.

Preferably, the at least two of the primary lines of severance extend from the first corner of the at least one aperture in a first direction and from the second corner of the at least one aperture in a second direction.

Preferably, the access device comprises a minor line of severance which extends from a third corner of the aperture in a third direction.

According to a third aspect of the present invention, there is provided a carton for packaging one or more articles comprising a plurality of walls including a top wall, a first side wall, a second side wall, a first end wall, a second end wall and a bottom wall, the carton having an access device for accessing said one or more articles, the access device comprising a plurality of primary lines of severance which are defined in the first side wall, the second side wall, the first end wall and the top wall so as to define a detachable corner of the carton, wherein the access device comprises an aperture in each of the first and second side walls and struck therefrom, which apertures each separates at least two of the primary lines of severance to control tearing of the primary lines of severance, the access device comprising a fold line extending transversely across the top wall for enabling folding of the detachable corner when in a partially detached condition, a first minor line of severance defined in the first side wall extending between the aperture in the first side wall and a first end of the fold line and a second minor line of severance defined in the second side wall extending between the aperture in the second side wall and a second end of the fold line, the first and second minor lines of severance being arranged contiguously with the fold line.

Preferably, the access device comprises a tear initiation device.

Preferably, the tear initiation device comprises a tab defined in part by at least one aperture and in part by at least one of the primary lines of severance, wherein the tab is hinged to the detachable corner by a fold line.

Alternatively, said at least one aperture is substantially triangular in shape.

Preferably, the at least two of the primary lines of severance extends from the first corner of the at least one aperture in a first direction and from the second corner of the at least one aperture in a second direction.

Preferably, the access device comprises a minor line of severance which extends from a third corner of the aperture in a third direction.

According to a fourth aspect of the present invention, there is provided a carton for packaging one or more articles comprising a plurality of walls including a top wall, a first side wall, a second side wall, a first end wall, a second end wall and a bottom wall, the carton having an access device for accessing one or more articles in the carton, the access device comprising a plurality of primary lines of severance which are defined in the first side wall, the second side wall, the first end wall and the top wall so as to define a detachable corner of the carton, wherein the access device comprises at least one cut line which separates at least two of the primary lines of severance for controlling tearing of the primary lines of severance.

Preferably, the cut line comprises first and second end portions which are shaped to return towards the at least two of the primary lines of severance for mitigating against propagation of tears away from the primary lines of severance.

According to a fifth aspect of the present invention, there is provided a blank for forming a carton, the blank comprising a plurality of panels including a top wall, a first side wall, a second side wall, a first end wall, a second end wall and a bottom wall, the blank having an access device for accessing said one or more articles, the access device comprising a plurality of primary lines of severance which are defined in the first side wall, the second side wall, the first end wall and the top wall so as to define a detachable corner of a set-up carton, wherein the access device comprises a fold line extending transversely across the top wall for enabling folding of the detachable corner when in a partially detached condition.

Preferably, the access device comprises a first minor line of severance defined in the first side wall extending from a first end of the fold line generally towards at least one of the primary lines of severance in the first side wall, and a second minor line of severance defined in the second side wall extending from a second end of the fold line generally towards at least one of the primary lines of severance, the first and second minor lines of severance being arranged contiguously with the fold line.

According to a sixth aspect of the present invention there is provided a blank for forming a carton, the blank comprising a plurality of panels including a top wall, a first side wall, a second side wall, a first end wall, a second end wall and a bottom wall, the blank having an access device for accessing said one or more articles, the access device comprising a plurality of primary lines of severance which are defined in the first side wall, the second side wall, the first end wall and the top wall so as to define a detachable corner of a set-up carton, wherein the access device comprises at least one aperture which separates at least two of the primary lines of severance for controlling tearing of the primary lines of severance.

Preferably, the access device comprises a tear initiation device for facilitating initiation of a tear developing along the primary lines of severance for removal of the corner portion; the primary lines of severance include a tear completion point where the tear stops developing when the corner portion is fully separated from the carton, and the at least one aperture is located along the primary lines of severance between the tear initiation device and the tear completion point, the at least one aperture being spaced apart from either one of the tear initiation device and the tear completion point.

According to a seventh aspect of the present invention, there is provided a blank for forming a carton, the blank comprising a plurality of panels for forming a top wall, a first side wall, a second side wall, a first end wall, a second end wall and a bottom wall, the blank having an access device for accessing said one or more articles, the access device comprising a plurality of lines of severance which are defined in the first side wall, the second side wall, the first end wall and the top wall so as to define a detachable corner of a set-up carton, wherein the access device comprises an aperture in each of the first and second side walls and struck therefrom, which apertures each separates at least two of the lines of severance for controlling tearing of the lines of severance, the access device comprising a fold line extending transversely across the top wall for enabling folding of the detachable corner when in a partially detached condition, a first minor line of severance defined in the first side wall extending between the aperture in the first side wall and a first end of the fold line and a second minor line of severance defined in the second side wall extending between the aperture in the second side wall and a second end of the fold line, the first and second minor lines of severance being arranged contiguously with the fold line.

According to an eighth aspect of the present invention, there is provided a blank for forming a carton, the blank comprising a plurality of panels including a top wall, a first side wall, a second side wall, a first end wall, a second end wall and a bottom wall, the blank having an access device for accessing one or more articles in the carton, the access device comprising a plurality of primary lines of severance which are defined in the first side wall, the second side wall, the first end wall and the top wall so as to define a detachable corner of a set-up carton, wherein the access device comprises at least one cut line which separates at least two of the primary lines of severance.

Preferably, the cut line comprises first and second end portions which are shaped to return towards the at least two of the primary lines of severance for mitigating against propagation of tears away from the primary lines of severance.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
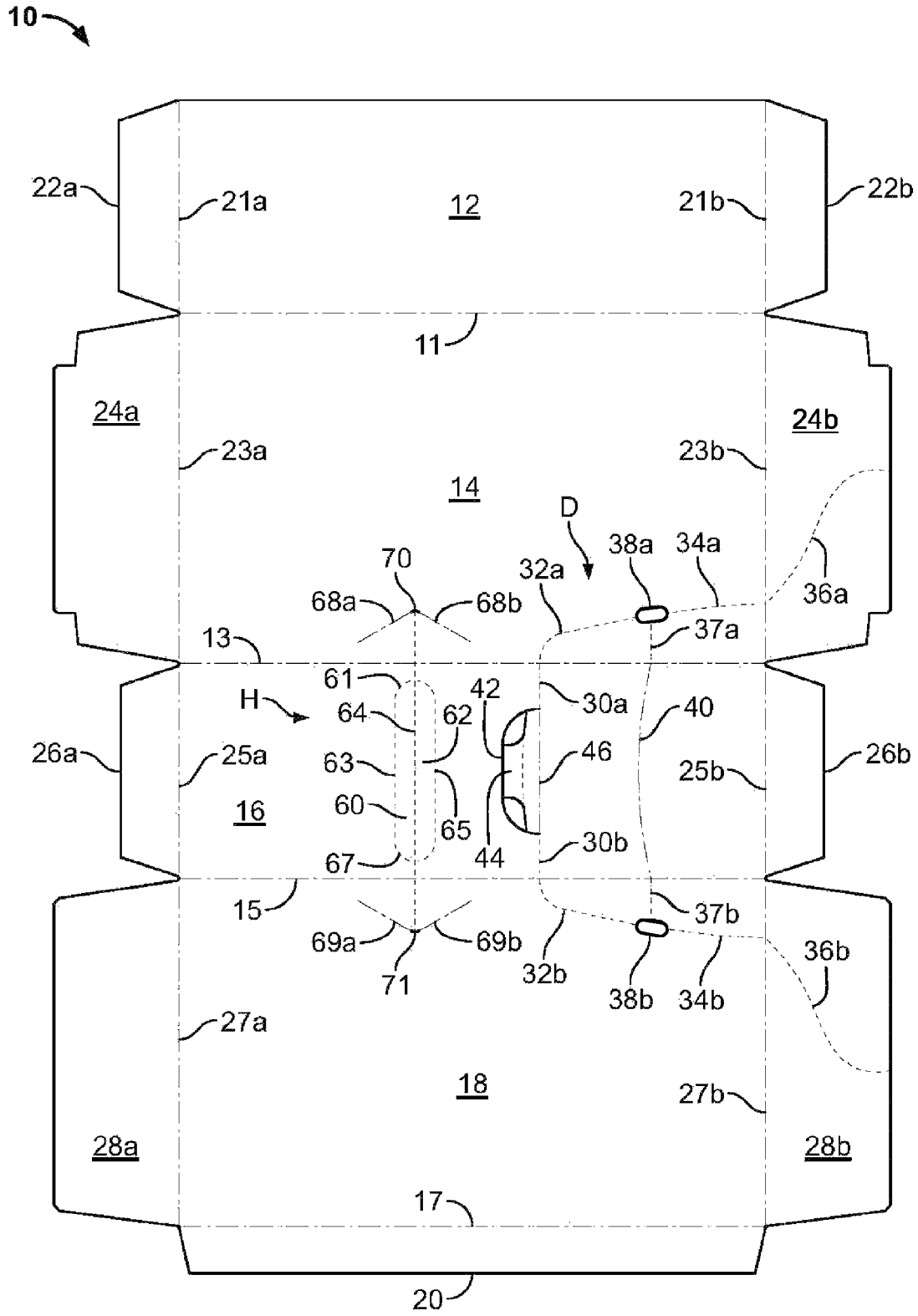
FIG. 1 is a plan view from above of a blank for forming a carton according to a first embodiment of the invention.
Figure 2:
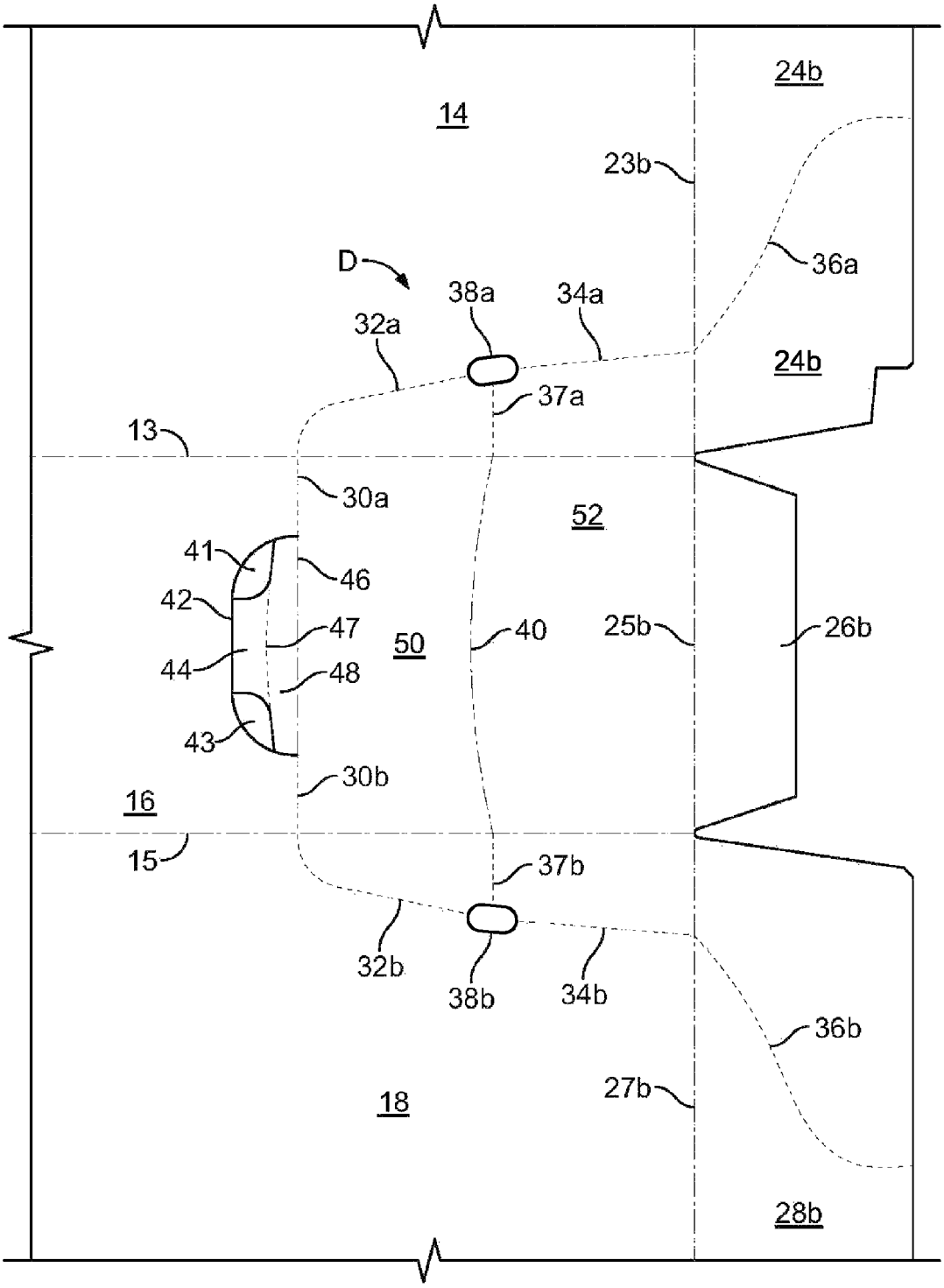
FIG. 2 is an enlarged plan view from above of a first portion of the blank of FIG. 1.

Referring to FIGS. 1 and 2 there is shown a plan view of a blank 10 capable of forming a carton 90, shown in FIG. 3, for packaging one or more primary product containers such as, but not limited to, bottles or cans, hereinafter referred to as articles C.

In the embodiments detailed herein, the terms 'carton' and 'carrier' refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blank 10 is configured to form a carton 90 or carrier for packaging an exemplary arrangement of exemplary articles. In a first illustrated exemplary embodiment, the arrangement is a 3×5 matrix or array and the articles are cans. The blank 10 can be alternatively configured to form a carrier 90 for packaging other types, number and size of article and/or for packaging articles in a different arrangement or configuration.

The blank 10 comprises a plurality of main wall panels 12, 14, 16, 18 for forming: a bottom wall 12, a first side wall 14, a top wall 16 and a second side wall 18 in a set-up carton 90. A glue panel 20 is hinged to the second side wall panel 18 along a fold line 17; in other embodiments the glue panel 20 may be hinged to the bottom wall panel 12. The bottom wall panel 12 is hinged to the first side wall panel 14 by a fold line 11. The first side wall panel 14 is hinged to the top wall panel 16 by a fold line 13. The top wall panel 16 is hinged to the second side wall panel 18 by a fold line 15.

The plurality of main panels 12, 14, 16, 18 form a tubular structure in a set-up condition. Each of the ends of the tubular structure are at least partially closed by end closure panels 22*a*, 24*a*, 26*a*, 28*a*, 22*b*, 24*b*, 26*b*, 28*b*. End closure panels 22*a*, 24*a*, 26*a*, 28*a* are configured to close a first end of the tubular structure and end panels 22*b*, 24*b*, 26*b*, 28*b* are configured to close a second end of the tubular structure. A first end closure panel 22*a* is hinged to a first end of bottom wall panel 12 by a fold line 21*a*. A second end closure panel 24*a* is hinged to a first end of first side wall panel 14 by a fold line 23*a*. A third end closure panel 26*a* is hinged to a first end of top wall panel 16 by a fold line 25*a*. A fourth end closure panel 28*a* is hinged to a first end of the second side wall panel 18 by a fold line 27*a*.

A fifth end closure panel 22*b* is hinged to a second end of bottom wall panel 12 by a fold line 21*b*. A sixth end closure panel 24*b* is hinged to a second end of first side wall panel 14 by a fold line 23*b*. A seventh end closure panel 26*b* is hinged to a second end of top wall panel 16 by a fold line 25*b*. An eighth end closure panel 28*b* is hinged to a second end of the second side wall panel 18 by a fold line 27*b*.

The blank 10 comprises a handle structure H which comprises a pair of elongate tabs 60, 62, which are defined in part by a severance line 64. The severance line 64 extends transversely across the top wall panel 16 and into each of the first and second side wall panels 14, 18. A first elongate tab 60 is defined in part by a first fold line 63, which is disposed in a spaced apart parallel relationship to the severance line 64. A second elongate tab 62 is defined in part by a second fold line 65 which is disposed in a spaced apart parallel relationship to the severance line 64. The first and second fold lines 63, 65 are disposed on opposing sides of the severance line 64. A first arcuate cutline 61 defines first ends of each of the first and second elongate tabs 60, 62. The first arcuate cutline 61 extends between a first end of the first fold line 63 and a first end of the second fold line 65, across the severance line 64. A second arcuate cutline 67 defines second ends of each of the first and second elongate tabs 60, 62. The second arcuate cutline 67 extends between a second end of the first fold line 63 and a second end of the second fold line 65, across the severance line 64.

The handle structure H comprises a pair of fold or crease lines 68*a*, 68*b* at a first end of line of severance 64. The first end of the severance line 64 is disposed in the first side wall panel 14 and terminates in a "V" shaped cutline 70 wherein each of the arms of the "V" shaped cutline 70 form a vertex, the vertex being disposed at the first end of the severance line 64.

A first crease line 68*a* commences from a first end of the "V" shaped cutline 70 towards the fold line 13 between the top wall panel 16 and the first side wall panel 14. A second crease line 68*b* commences from a second end of the "V" shaped cutline 70 towards the fold line 13 between the top wall panel 16 and the first side wall panel 14. The first and second crease lines 68*a*, 68*b* together with the "V" shaped cutline 70 form an inverted "V" shape which converges at the first end of the severance line 64.

The handle structure H comprises a second pair of fold or crease lines 69*a*, 69*b* at a second end of line of severance 64. The second end of the severance line 64 is disposed in the second side wall panel 18 and terminates in "V" shaped cutline 71 wherein each of the arms of the "V" shaped cutline 71 form a vertex, the vertex being disposed at the second end of the severance line 64.

A third crease line 69*a* commences from a first end of the "V" shaped cutline 71 towards the fold line 15 between the top wall panel 16 and the second side wall panel 18. A crease line 69*b* commences from a second end of the "V" shaped cutline 71 towards the fold line 15 between the top wall panel 16 and the second side wall panel 18. The third and fourth crease lines 69*a*, 69*b* together with the "V" shaped cutline 71 form a "V" shape which converges at the second end of the severance line 64.

Figure 9:
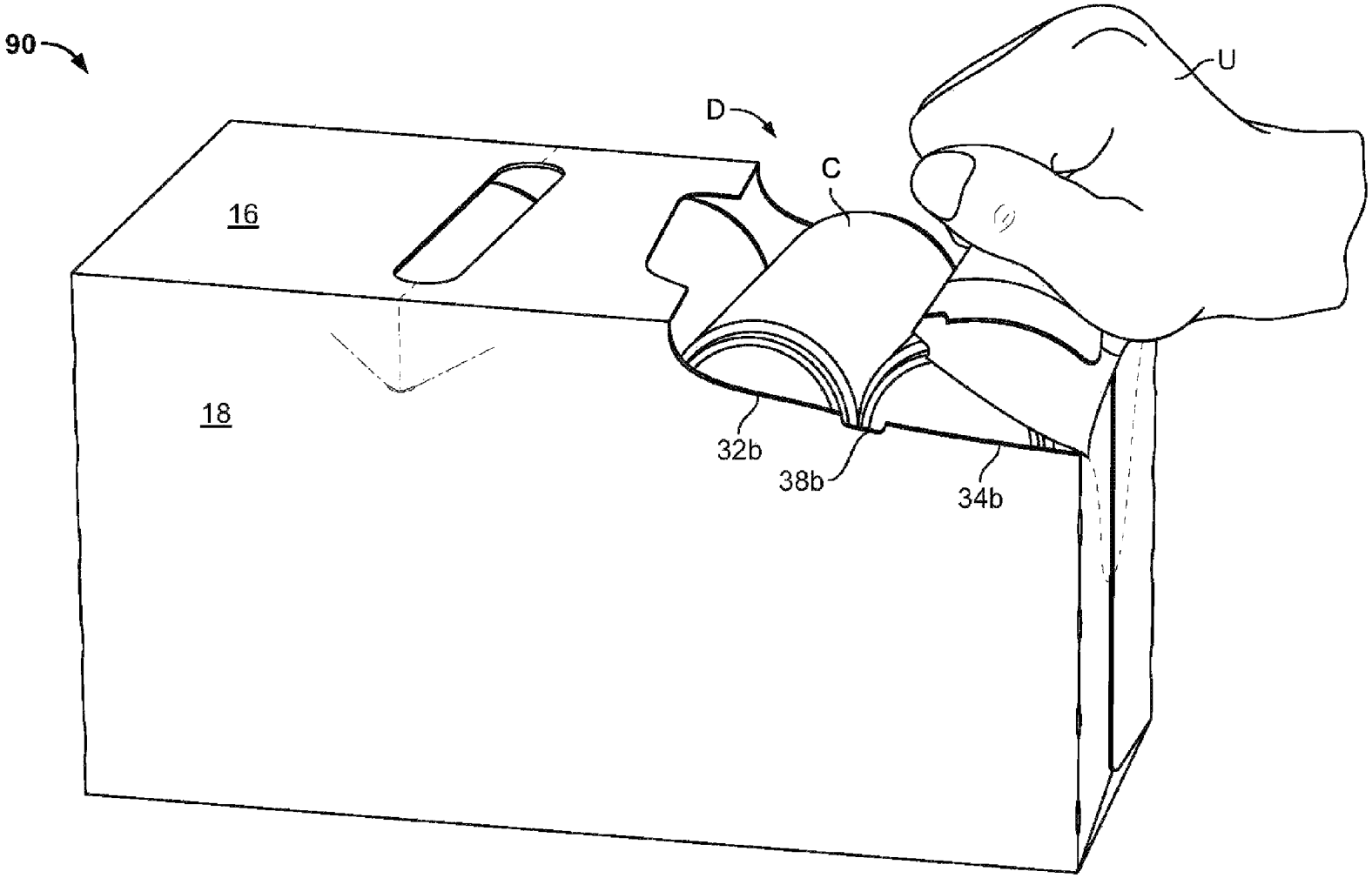
Figure 10:
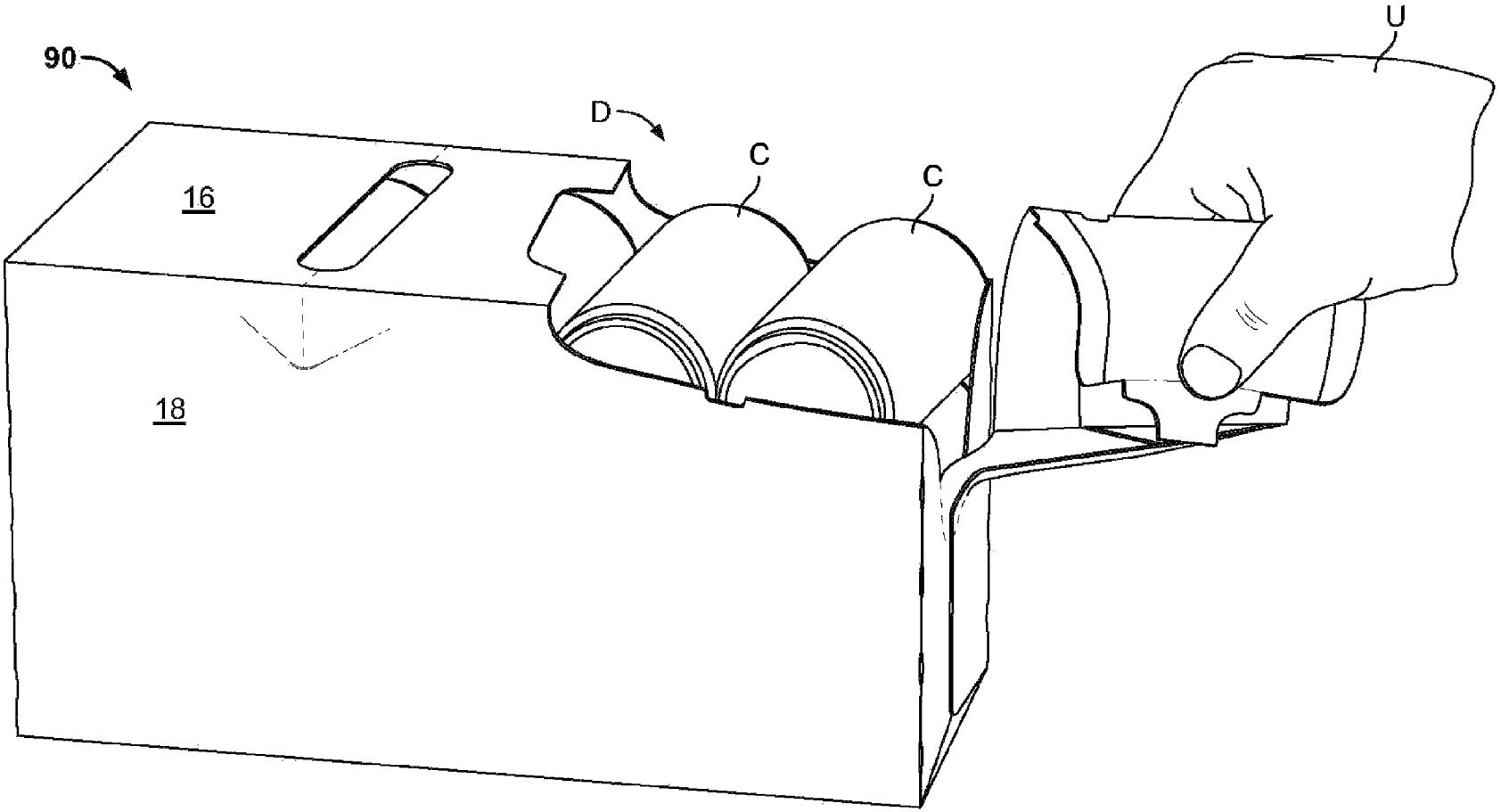
Figure 11:
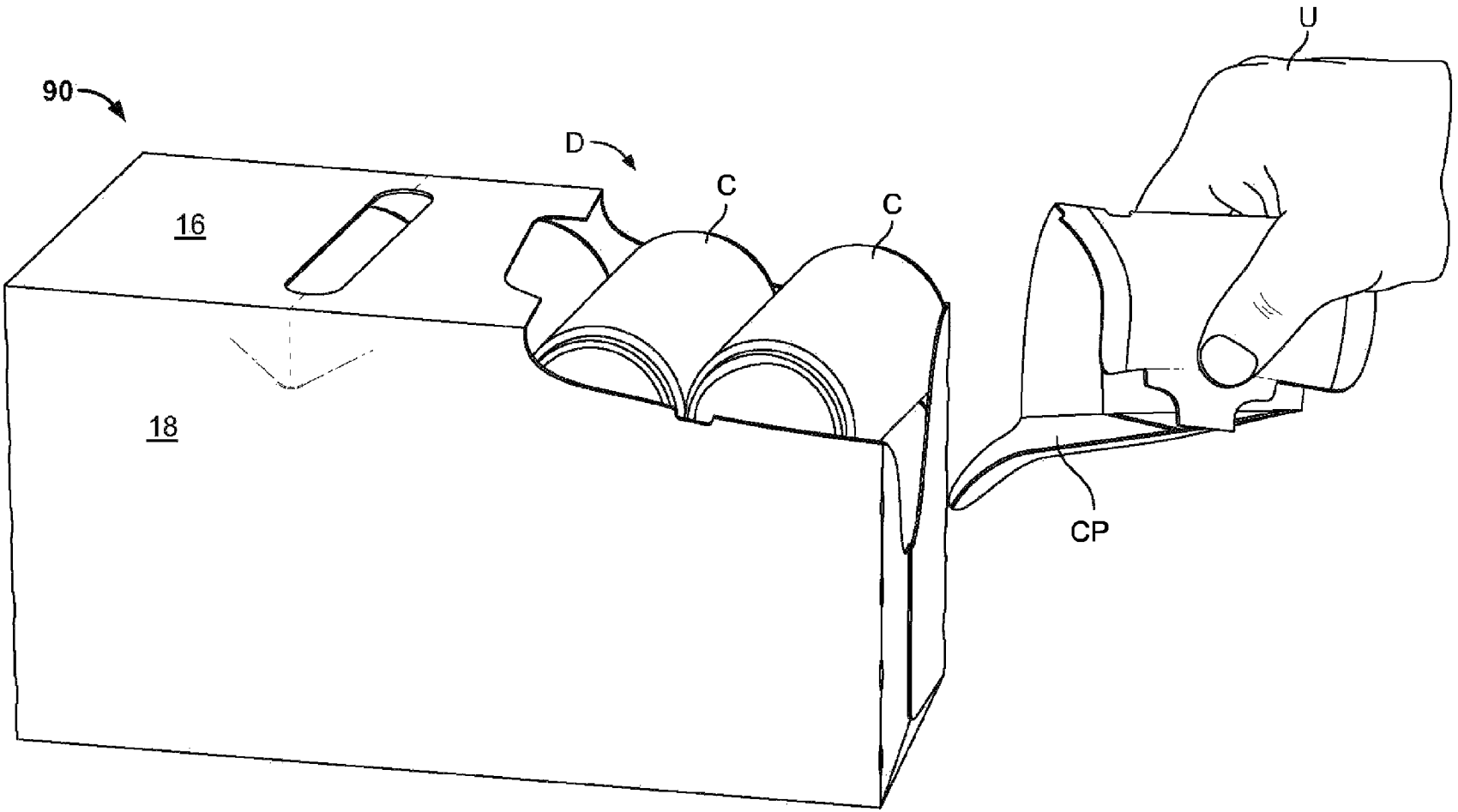

An access device D is provided for removal of a corner portion C of the carton 90 (see FIGS. 3 to 12, in particular FIG. 11). Removal of the corner portion C separates a portion of the top wall panel 16 from the carton 90. Removal of the corner portion C separates a portion of each of the first and second side walls 14, 18 and the end wall formed by the end closure panels 22*b*, 24*b*, 26*b*, 28*b*.

The access device D comprises a plurality of lines of severance, including a first line of severance 36*a* which extends across the sixth end closure panel 24*b* and is contiguous with a second line of severance 34*a* defined in the first side wall 14, best shown in FIG. 2. The second line of severance 34*a* extends across the first side wall 14 to meet an aperture 38*a* struck from the first side wall 14. A third line of severance 32*a* extends from the aperture 38*a* across the first side wall 14 to meet the fold line 13 between the top wall panel 16 and the first side wall 14.

The access device D further comprises a fourth line of severance 36*b*, which extends across the eighth end closure panel 28*b* and is contiguous with a fifth line of severance 34*b* defined in the second side wall 18. The fifth line of severance 34*b* extends across the second side wall 18 to meet an aperture 38*b* struck from the second side wall 18. A sixth line of severance 32*b* extends from the aperture 38*b* across the second side wall 18 to meet the fold line 15 between the top wall panel 16 and the second side wall 18.

The access device D further comprises a seventh line of severance 30*a* which extends transversely partially across the top wall panel 16. The seventh line of severance 30*a* is arranged to be contiguous with the third line of severance 32*a*.

The access device D still further comprises an eighth line of severance 30*b* which extends transversely partially across the top wall panel 16. The eighth line of severance 30*b* is arranged to be contiguous with the sixth line of severance 32*b*. The seventh line of severance 30*a* and eighth line of severance 30*b* are arranged to be collinear with each other.

The seventh and eighth lines of severance 30*a*, 30*b* may be continuous with one another. In such an embodiment, the first, second, third, fourth, fifth, sixth, seventh and eighth lines of severance 36*a*, 34*a*, 32*a*, 30*a*, 36*b*, 34*b*, 32*b*, 30*b* provide primary lines of severance respectively, along which the corner portion C may be removed from the carton 90.

In an alternative embodiment, the access device D may further comprise an optional finger engagement or tear initiation device. The tear initiation device comprises a tab 44 defined in the top wall panel 16. The tab 44 is defined in part by a fold line 46. Fold line 46 interrupts the seventh and eighth lines of severance 30*a*, 30*b* so as to be contiguous therewith. Preferably, seventh and eighth lines of severance 30*a*, 30*b* and fold line 46 are collinear. The tab 44 is defined in part by a ninth line of severance 42, and in part by each of a pair of apertures 41, 43. Ninth line of severance 42 is substantially "U" shaped and comprises a first and a second end, each of which is adjacent to or contiguous with a respective one of the ends of the fold line 46. The ninth line of severance 42 is interrupted by, or is contiguous with, the pair of apertures 41, 43. In this alternative embodiment, the first, second, third, fourth, fifth, sixth, seventh, eighth and ninth lines of severance 36*a*, 34*a*, 32*a*, 30*a*, 36*b*, 34*b*, 32*b*, 30*b*, 42 provide primary lines of severance respectively, along which the corner portion C may be removed from the carton 90.

A further optional fold line 47 is provided across the tab 44 and extends transversely with respect to a tubular axis of the set-up carton 90. The further optional fold line 47 divides the tab 44 into a first part 44 and a second part 48.

The access device D comprises a fold line 40 extending transversely across the top wall panel 16. Optionally, the fold line 40 is arcuate or curved. Preferably, the fold line 40 is concave when viewed from the end of the carton 90 which is closed by the end closure panels 22*b*, 24*b*, 26*b*, 28*b*. The access device D also comprises a tenth line of severance 37*a*. The tenth line of severance 37*a* extends from the aperture 38*a* across the first side wall panel 14. The tenth line of severance 37*a* is disposed substantially parallel to the fold line 23*b* between the first side wall panel 14 and the sixth end closure panel 24*b*. The tenth line of severance 37*a* is disposed substantially perpendicularly to the fold line 13 between the first side wall panel 14 and the top wall panel 16.

The access device also comprises an eleventh line of severance 37*b*. The eleventh line of severance 37*b* extends from the aperture 38*b* across the second side wall panel 18. The eleventh line of severance 37*b* is disposed substantially parallel to the fold line 27*b* between the second side wall panel 18 and the eighth end closure panel 28*b*. The eleventh line of severance 37*b* is disposed substantially perpendicularly to the fold line 15 between the second side wall panel 18 and the top wall panel 16.

The tenth line of severance 37*a*, eleventh line of severance 37*b* and fold line 40 are arranged so as to be contiguous, such that they extend between the aperture 38*a* in the first side wall panel 14 and the aperture 38*b* in the second side wall panel 18. Stated differently, the tenth and eleventh lines of severance 37*a*, 37*b* provide first and second minor lines of severance respectively that are disposed continuously with the fold line 40 which is interposed between the minor lines of severance 37*a*, 37*b*.

The fold line 40 defines in part a first portion 50 of the top wall panel 16 and in part a second portion 52 of the top wall panel 16 which are detached when the corner portion C is removed.

Figure 3:
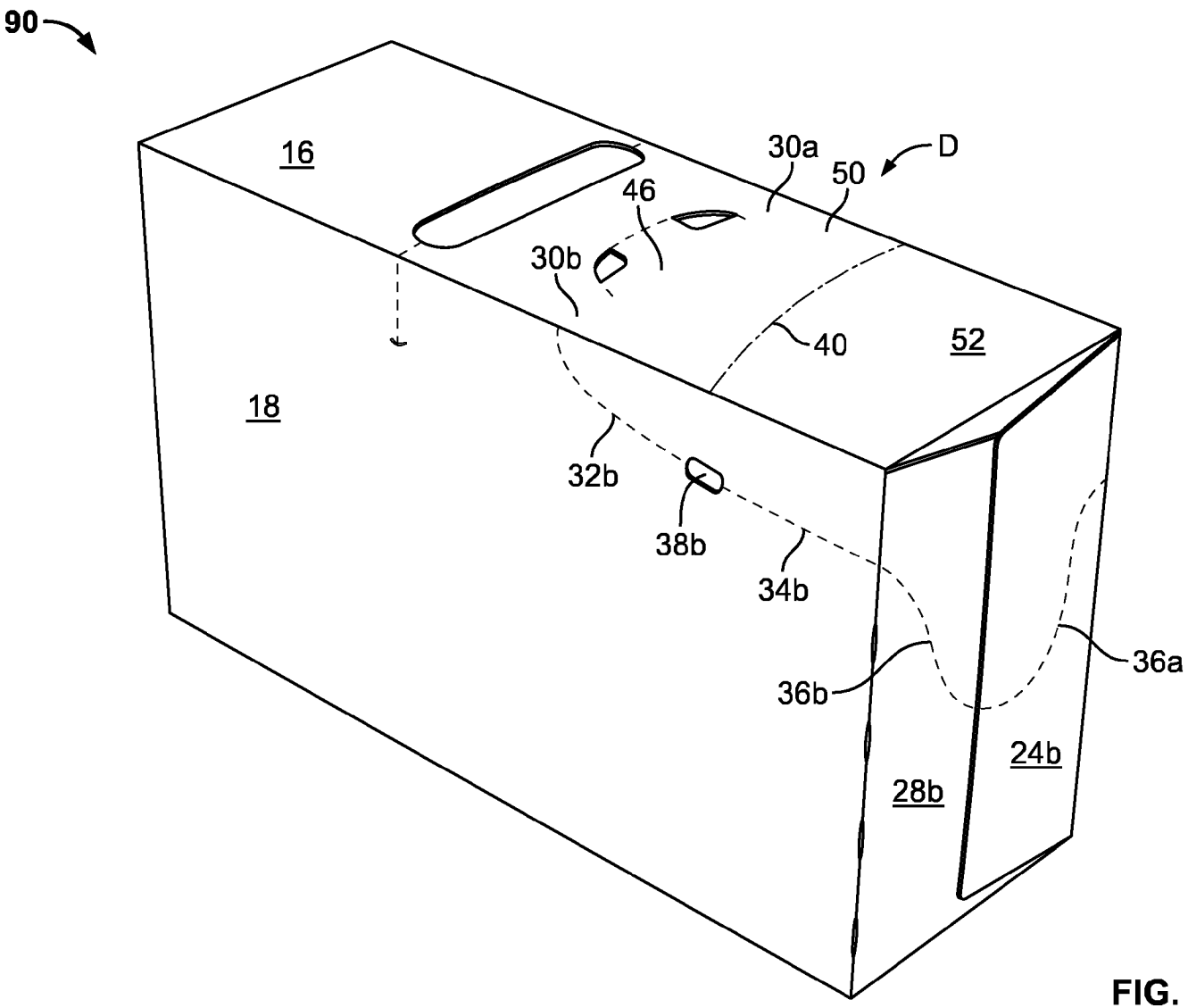
FIG. 3 is a perspective view from above of a carton formed from the blank of FIG. 1.
Figure 4:
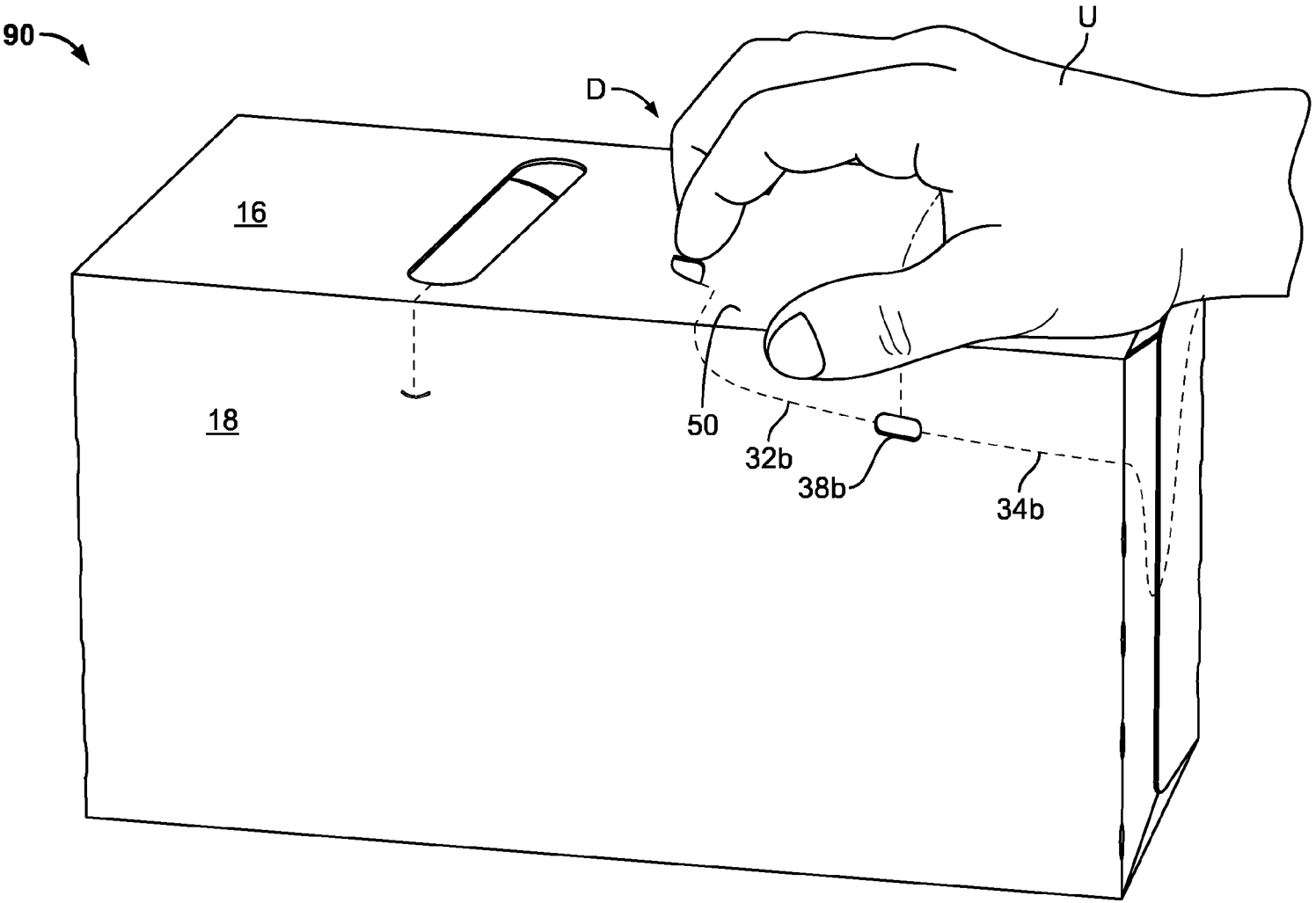
FIGS. 4 to 11 are perspective views from above of a carton formed from the blank of FIG. 1 showing deployment of a dispenser.

Turning to the construction of the carton 90 as illustrated in FIG. 3, the carton 90 can be formed by a series of sequential folding operations in a straight line machine so that the carton 90 is not required to be rotated or inverted to complete its construction. The folding process is not limited to that described below and may be altered according to particular manufacturing requirements.

The carton 90 is formed by folding the glue panel 20 about the fold line 17 to overlie the second side wall panel 18. The bottom wall panel 12 and the first side wall panel 14 are folded about the fold line 13 such that the first side wall panel 14 overlies the top wall panel 16 and the bottom wall panel 12 overlies the glue panel 20 and the second side wall panel 18. Glue or other adhesive treatment is applied to the glue panel 20 and/or to a corresponding area of the bottom wall panel 12. The bottom wall panel 12 is secured to the glue panel 20 to form a flat collapsed tubular structure. This flat collapsed tubular structure can be shipped or transported to a converter plant. At the converter plant the flat collapsed tubular structure is opened and erected to form a tubular structure having a substantially square or rectangular cross-sectional shape.

The erected tubular structure is loaded with articles through one or both open ends. One or more of the end closure panels 22*a*, 24*a*, 26*a*, 28*a*, 22*b*, 24*b*, 26*b*, 28*b* may be folded outwardly to act as a funnel to facilitate insertion of the articles into the carton 90.

Once the articles are loaded into the tubular structure the ends of the tubular structure are closed. A first end of the tubular structure is closed by folding the first end closure panel 22*a* about fold line 21*a* and folding third end closure panel 26*a* about fold line 25*a*. Glue or other adhesive treatment is applied to an outer surface of the first and third end closure panels 22*a*, 26*a*. In alternative embodiments the glue or adhesive treatment is applied to an inner surface of the corresponding region of the second and fourth end closure panels 24*a*, 28*a*. The second end closure panel 24*a* is then folded about the fold line 23*a* and is secured to the first and third end closure panels 22*a*, 26*a*. Glue or adhesive treatment is applied to an outer surface of the second end closure panel 24*a* and/or to an inner surface of the fourth end closure panel 28*a*. The fourth end closure panel 28*a* is folded about fold line 27*a* and brought into contact with the second end closure panel 24*a* such that part of the fourth end closure panel 28*a* is in overlapping relationship with part of the second end closure panel 24*a* and is secured and affixed thereto.

A second end of the tubular structure is closed by folding the fifth end closure panel 22*b* about fold line 21*b* and folding seventh end closure panel 26*b* about fold line 25*b*. Glue or other adhesive treatment may be applied to an outer surface of the fifth and seventh end closure panels 22*b*, 26*b*. In alternative embodiments the glue or adhesive treatment is applied to an inner surface of the corresponding region of the sixth and eighth end closure panels 24*b*, 28*b*. The sixth end closure panel 24*b* is folded about the fold line 23*b* and secured to the fifth and seventh end closure panels 22*b*, 26*b*. Glue or adhesive treatment is applied to an outer surface of the sixth end closure panel 24*b* or to an inner surface of the eighth end closure panel 28*b*. The eighth end closure panel 28*b* is folded about fold line 27*b* and brought into contact with the sixth end closure panel 24*b* such that a portion of the eighth end closure panel 28*b* is in overlapping relationship with a portion of the sixth end closure panel 24*b* and is secured thereto.

In some embodiments one end of the tubular structure may be closed before loading articles through a remaining open end of the tubular structure.

Figure 5:
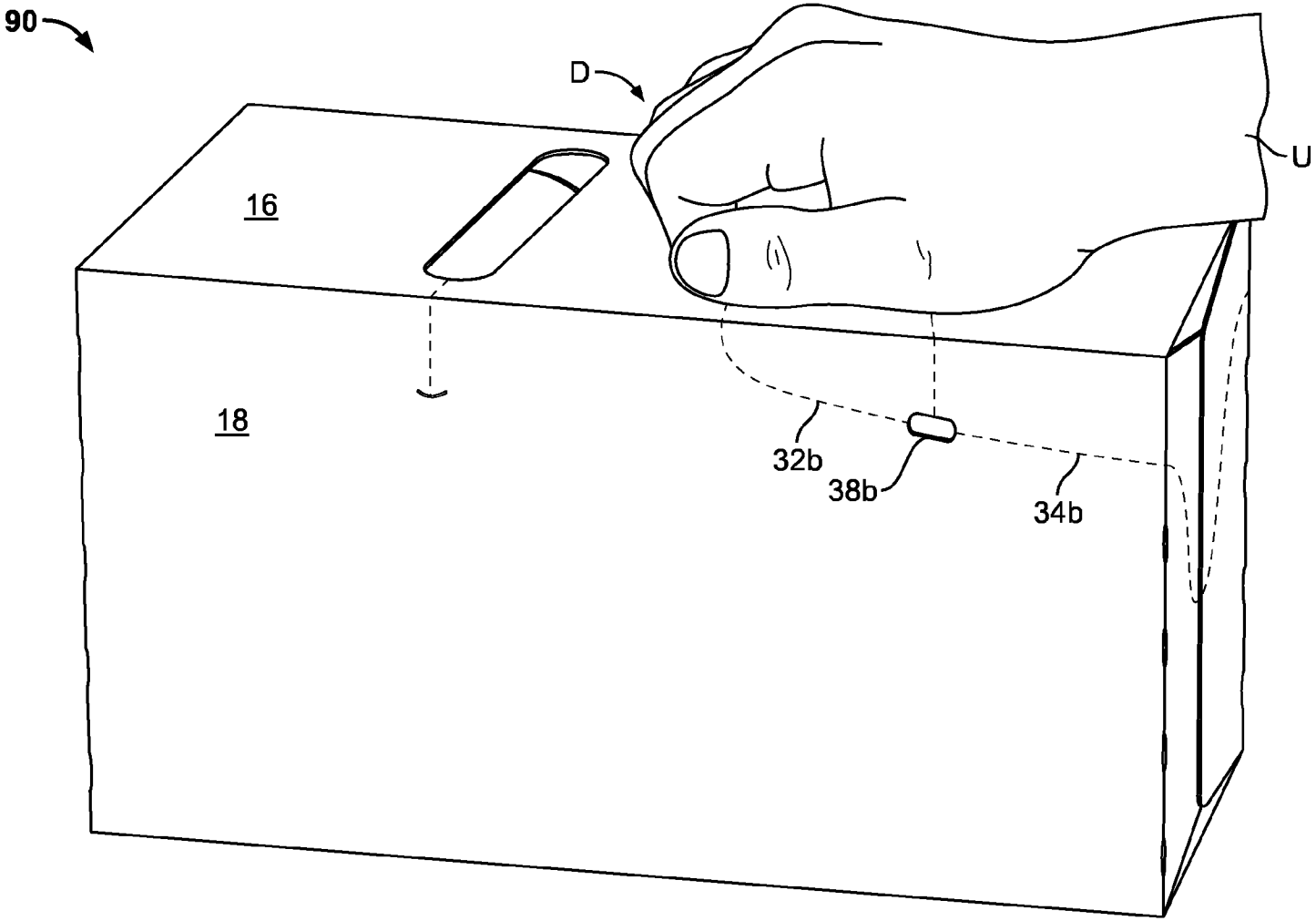
Figure 6:
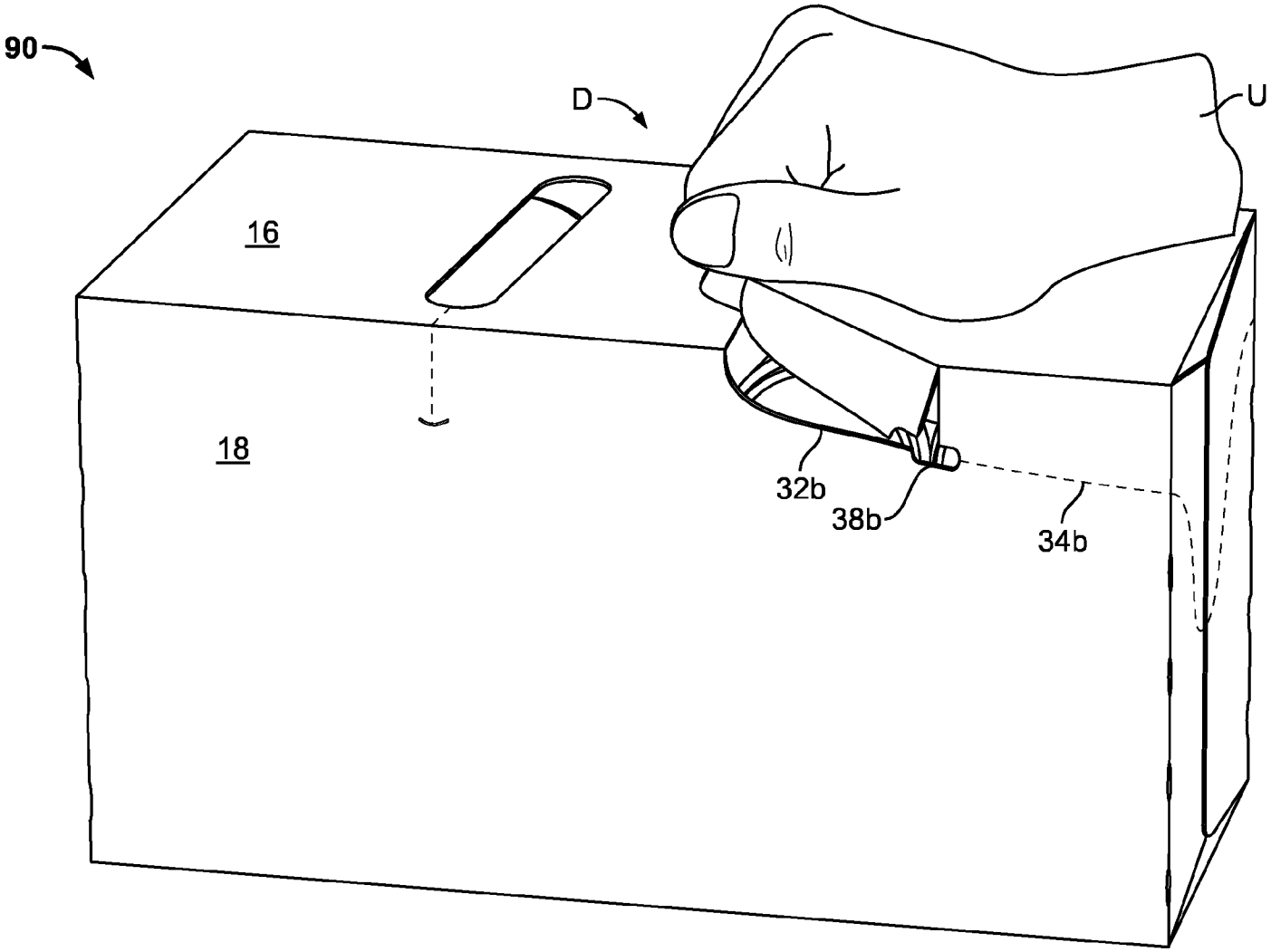
Figure 7:
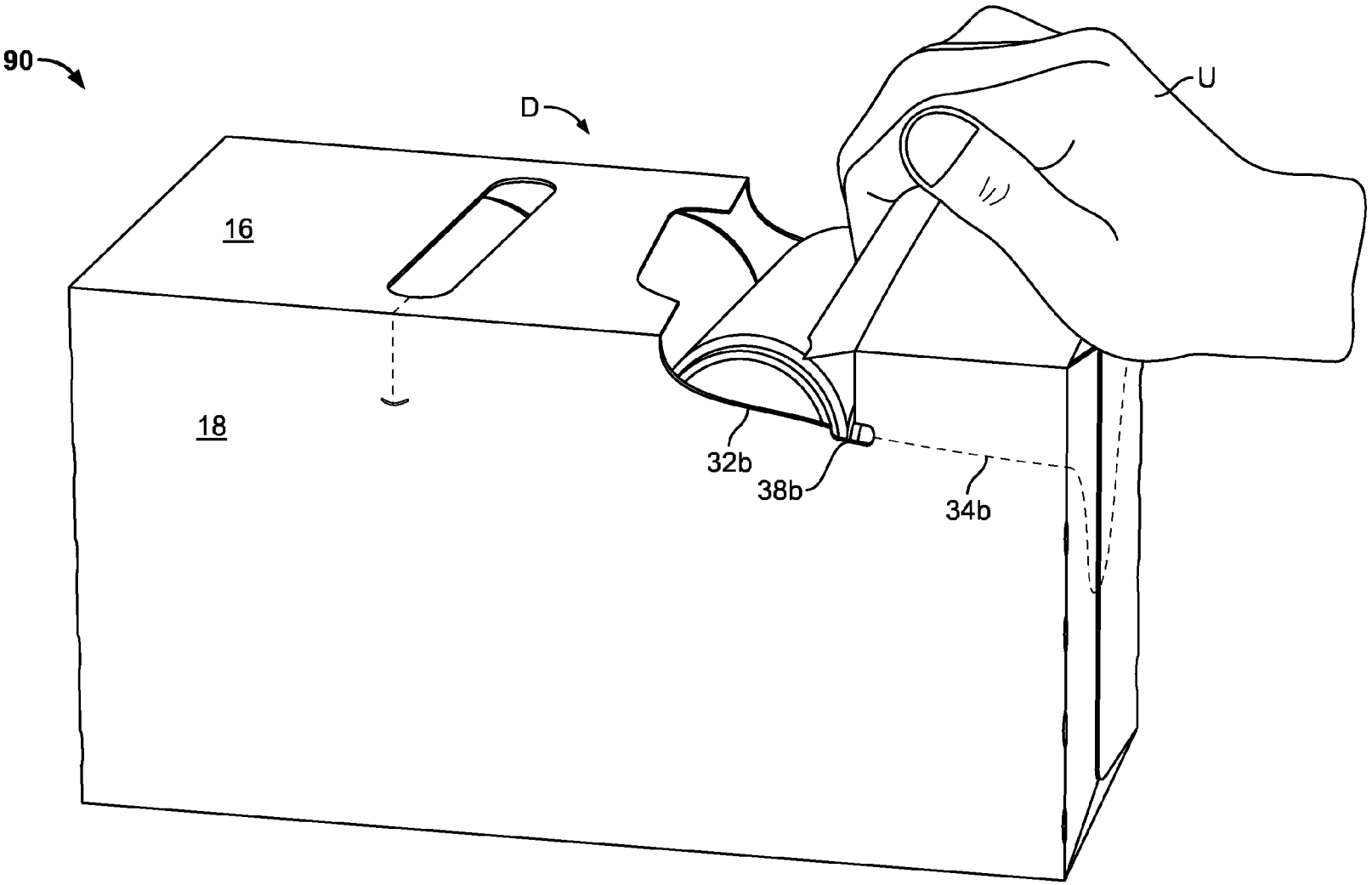
Figure 8:
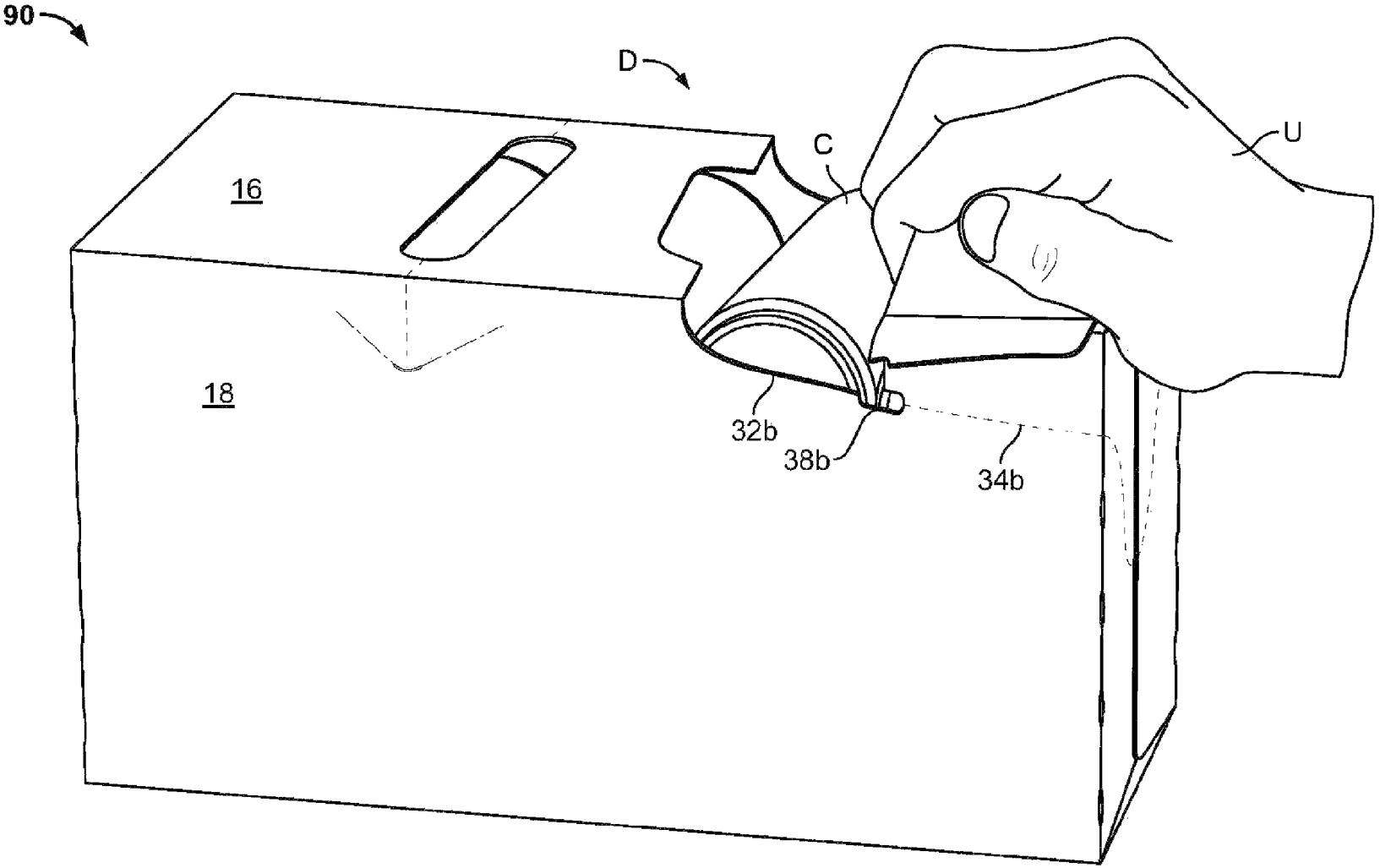

The assembled carton 90 is shown in FIG. 3. A portion of the first line of severance 36*a* is arranged to be in registry with a portion of the fourth line of severance 36*b* when the eighth end closure panel 28*b* is in overlapping relationship with the sixth end closure panel 24*b*. As described later in more detail, the illustrated corner portion C of this embodiment is designed such that the removal or separation of the corner portion from the carton 90 is initiated preferably by a carton user U to grab the tear initiation device and pull it upward. By that means, a tear develops from the tear initiation device along the seventh and eighth lines of severance 30*a*, 30*b* till it is stopped by the apertures 38*a* and 38*b*. The tear then propagates along the tenth and eleventh lines of severance 37*a*, 37*b*. Finally, the tear is initiated along the second and fifth lines of severance 34*a*, 34*b* until it eventually propagates into the end closure panels 24*b*, 28*b* along the first and fourth lines of severance 36*a*, 36*b* and finalizes its development at a tear completion point "P" (FIG. 3) located along the registered portions of the first and fourth lines of severance 36*a*, 36*b*. When the tears downwardly developing along both the first and fourth lines of severance 36*a*, 36*b* meet at the tear completion point "P", all tear "stops" developing because by that moment, all the lines of severance have been completely broken or cut by the tear. At that moment, the tearing process is complete and the corner portion C is fully separate from the carton, FIGS. 4 to 11 illustrate a method of opening the access device D. In a first stage, shown in FIG. 4, a user U presses upon the tab 44 inwardly so as to sever the ninth line of severance 42 and push the tab 44 inside the carton 90. The user U then inserts one or more fingers into the aperture created by pushing the tab 44 into the carton 90, as shown in FIG. 5. The user U engages with the first portion 50 of the top wall 16. The tab 44 may be folded substantially into face contacting relationship with first portion 50 of the top wall 16 to form a folded edge for the user U to engage. The user U severs the seventh and eighth lines of severance 30*a*, 30*b* across the top wall 16 by pulling the portion 50 upwardly. As the user U continues to pull the third and sixth lines of severance 32*a*, 32*b* are severed up to the respective one of the apertures 38*a*, 38*b*. The tenth and eleventh lines of severance 37*a*, 37*b* are then severed between the respective one of the apertures 38*a*, 38*b* and the respective fold line 13, 15, as shown in FIG. 6. The user U then folds the first portion 50 about the fold line 40 so as to be in face contacting relationship with the second portion 52, as shown in FIG. 8. In those embodiments where the fold line 40 is arcuate, the top wall 16 is caused to bow outwardly such that the top wall 16 appears concave when viewed from inside the carton 90. The bowing of the top wall 16 creates a void or gap between the inner surface of the top wall 16 and the articles "A" disposed therebelow. This void allows the user easy access to engage with the inner surface of the top wall 16 defined by the second portion 52. The user U then engages the second portion 52 by the hinged edge formed by the fold line 40. The user U inserts one or more fingers below the second portion 52 and pulls upwardly, as shown in FIGS. 8 and 9. As the user U pulls the second portion 52 upwardly, the second and fifth lines of severance 34*a*, 34*b* are severed. The user then severs the first and fourth lines of severance 36*a*, 36*b* so as to detach the corner portion C from the carton 90 as shown in FIGS. 10 and 11.

Advantageously, the provision of the apertures 38*a*, 38*b* and the fold line 40 in the access device D facilitates a two-stage opening process. In the first stage, the user U severs the first portion 50 of the top wall 16 from the top wall 16. In the second stage the user U severs the second portion 52 from the carton 90 enabling the first and second portions 50, 52 to be detached from the carton 90. This two stage process makes the deployment of the access device D easier for the user especially when deployment of the access device D requires removal of a large portion of the top wall 16; removal of larger portions of the carton 90 requires longer lines of severance which require more effort to open than shorter lines of severance, for example, but not limited to, removal of a portion of the top wall 16 which is substantially equal to or greater than the diameter or width of an article being packaged. Alternatively, the access device may require removal of a portion of the top wall 16 which is substantially equal to or greater than the twice the diameter or width of an article. In yet other embodiments the length of the portion of the top wall 16 being removed may be equal to or greater than approximately two fifths of the length of the top wall 16.

The removal of the corner portion C exposes an endmost article adjacent to the removed corner in an uppermost row of a group of articles "A" disposed within the carton 90. The removal of the corner portion C also exposes an article in the uppermost row adjacent to the endmost article in the uppermost row. A portion of an endmost article in a row of articles C disposed below the uppermost row is also exposed when the corner portion C is removed.

The seventh and eighth lines of severance 30*a*, 30*b* are arranged so as to be disposed at a distance from the end wall formed from the end closure panels 22*b*, 24*b*, 26*b*, 28*b* which is approximately equal to twice the diameter or width of the articles C.

The second and third weakened lines 34*a*, 32*a* are arranged so as to expose a portion of the uppermost articles C. The second and third weakened lines 34*a*, 32*a* are disposed at a distance from the fold line 13, hinging the top wall 16 to the first side wall 14, which distance is between half and three quarters of the diameter or height of the articles C. The fifth and sixth weakened lines 34*b*, 32*b* are arranged similarly to the second and third weakened lines 34*a*, 32*a*. The fold line 40 is disposed in the top wall 16 at a distance from the fold line 25*b*, which forms a hinged connection between the top wall 16 and the seventh end closure panel 26*b*, which distance is approximately equal to the diameter or width of an article A being packaged.

The first and fourth lines of severance 36*a*, 36*b* are arranged such that when the corner portion C is removed a recess is formed in the end wall. The recess extends, at its greatest, a distance downwardly from the top wall 16 which is approximately equal to one and three quarters of the diameter or height of the articles "A" being packaged.

The access device D is configured to expose at least two articles C in the uppermost row. This requires removal of a large portion of the top wall 16. In order to facilitate removal of the corner portion C, the access device D comprises fold line 40 which allows the corner portion C to be removed in two stages. The apertures 38*a*, 38*b* which interrupt the second and third weakened lines 34*a*, 32*a* and the fifth and sixth weakened lines 34*b*, 32*b* also facilitate the removal of the corner portion C. The apertures 38*a*, 38*b* allow the direction of the tear or shearing action to be changed, such that the user U can sever the third and sixth weakened lines 32*a*, 32*b* and then change the direction of tear to sever the tenth and eleventh lines of severance 37*a*, 37*b*. The apertures 38*a*, 38*b* interrupt or stop the tear of the third and sixth weakened lines 32*a*, 32*b* such that the user U must initiate tearing of the second and fifth lines of severance 34*a*, 34*b* separately to tearing of the third and sixth weakened lines 32*a*, 32*b*.

In other embodiments the tenth and eleventh lines of severance 37*a*, 37*b* may terminate proximate to the respective one of the fold lines 13, 15. In yet other embodiments the tenth and eleventh lines of severance 37*a*, 37*b* may extend from the respective first or second side walls 14, 18 into the top wall 16. The tenth and eleventh lines of severance 37*a*, 37*b* create relief points in the opening process, and this makes the opening process easier and smoother for the user U.

In some embodiments the user U may omit the step of folding the first portion 50 about the fold line 40. The user U may continue pulling the first portion 50 upwardly away from the carton 90 and detaching the corner portion C from the carton 90.

Referring now to FIGS. 13 to 25, there are shown alternative embodiments of the present invention. In the second and third illustrated embodiments like numerals have, where possible, been used to denote like parts, albeit with the addition of the prefix "100" and "200", to indicate that these features belong to the second or third embodiment respectively. The alternative embodiments share many common features with the first embodiment and therefore only the differences from the embodiment illustrated in FIGS. 1 to 12 will be described in any greater detail.

Figure 13:
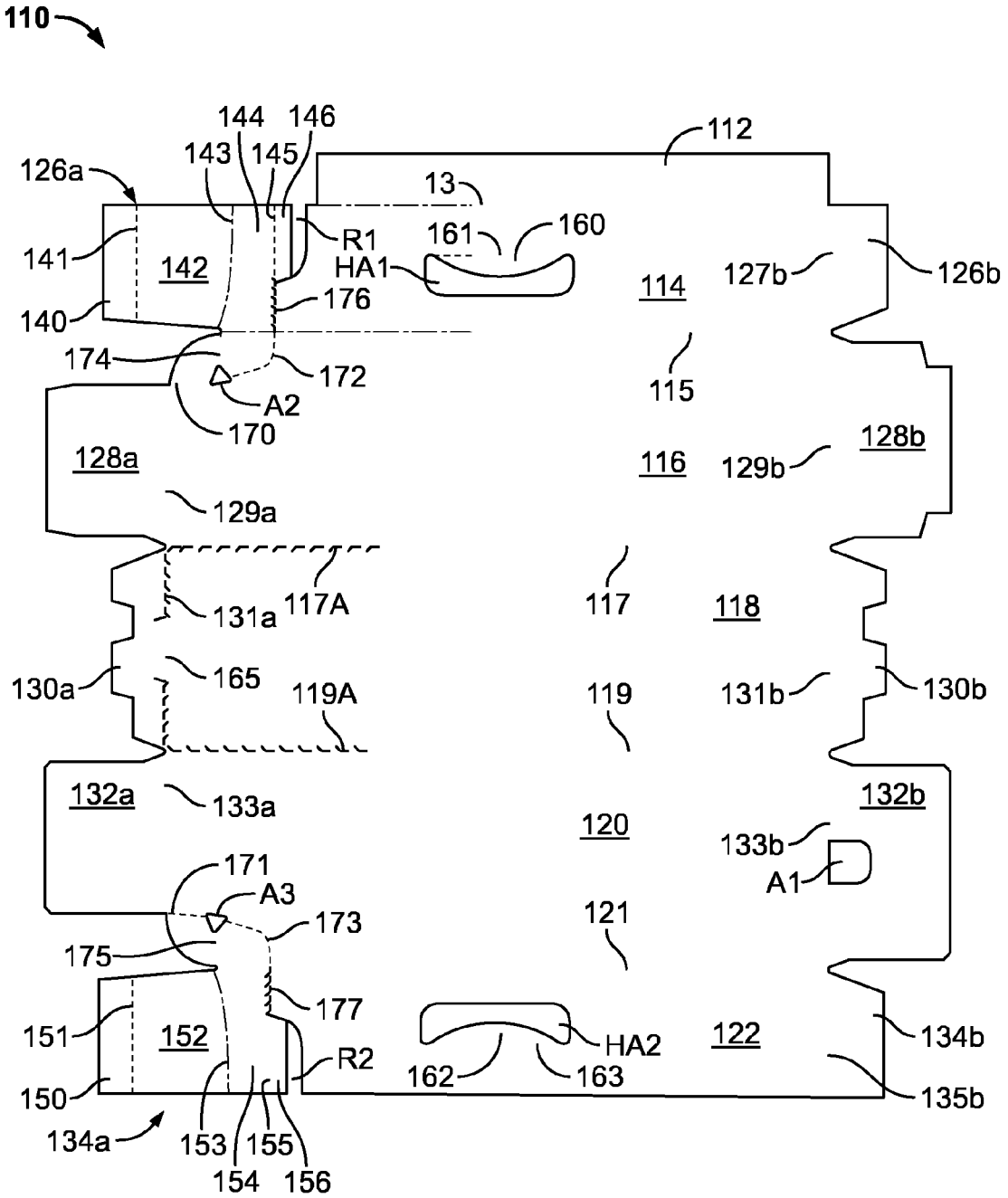
FIG. 13 is a plan view from above of a blank for forming a carton according to a second embodiment of the invention.

FIG. 13 shows a blank 110 for forming a carton 190 according to a second embodiment of the invention. The blank 110 comprises a plurality of main wall panels 114, 116, 118, 120, 122 including; a first top panel 114, a first side panel 116, a bottom panel 118, a second side panel 120 and a second top panel 122. A handle reinforcing panel 112 is hinged to the first top panel 114 along a fold line 113; in other embodiments the handle reinforcing panel 112 may be hinged to the second top panel 122. The first top panel 114 is hinged to the first side panel 116 by a fold line 115. The first side panel 116 is hinged to the bottom panel 118 by a fold line 117. The bottom panel 118 is hinged to the second side panel 120 by a fold line 119. The second side panel 120 is hinged to the second top panel 122 by a fold line 121.

The plurality of main panels 114, 116, 118, 120, 122 form a tubular structure in a set-up condition. Each of the ends of the tubular structure are at least partially closed by end closure panels 126*a*, 128*a*, 130*a*, 132*a*, 134*a*, 126*b*, 128*b*, 130*b*, 132*b*, 134*b*. End closure panels 126*a*, 128*a*, 130*a*, 132*a*, 134*a* are configured to close a first end of the tubular structure and end panels 126*b*, 128*b*, 130*b*, 132*b*, 134*b* are configured to close a second end of the tubular structure. A first end closure panel 126*a* is coupled to a first end of the first top panel 114. A second end closure panel 128*a* is hinged to a first end of first side panel 116 by a fold line 129*a*. A third end closure panel 130*a* is hinged to a first end of bottom panel 118 by a severable line 131*a*. A fourth end closure panel 132*a* is hinged to a first end of the second side panel 120 by a fold line 133*a*. A fifth end closure panel 134*a* is coupled to a first end of second top panel 122.

A sixth end closure panel 126*b* is hinged to a second end of first top panel 114 by a fold line 127*b*. A seventh end closure panel 128*b* is hinged to a second end of first side panel 116 by a fold line 129*b*. An eighth end closure panel 130*b* is hinged to a second end of the bottom panel 118 by a fold line 131*b*. A ninth end closure panel 132*b* is hinged to a second end of second side panel 120 by a fold line 133*b*. A tenth end closure panel 134*b* is hinged to a second end of the second top panel 122 by a fold line 135*b*.

A first end closure panel 126*a* and the fifth end closure panel 134*a* are configured to form a curved or arcuate corner at one end of the carton 90.

The first end closure panel 126*a* comprises a first securing panel 140, a first corner panel 142 and a first transition panel 144. The first securing panel 140 is coupled to the first corner panel 142 by a first line of severance 141. The first corner panel 142 is hinged to the first transition panel 144 by a fold line 143. The first transition panel 144 is coupled to the first top panel 114 by a line of severance 176. The first transition panel 144 is partially separated from first top panel 114 by a first recess or cutaway R1. The first transition panel 144 comprises a fold line 145 which defines a first tab 146 disposed adjacent to the first cutaway R1.

The fifth end closure panel 134*a* comprises a second securing panel 150, a second corner panel 152 and a second transition panel 154. The second securing panel 150 is hinged to the second corner panel 152 by a second line of severance 151. The second corner panel 152 is hinged to the second transition panel 154 by a fold line 153. The second transition panel 154 is coupled to the second top panel 122 by a line of severance 177. The second transition panel 154 is partially separated from second top panel 122 by a second recess or cutaway R2. The second transition panel 154 comprises a fold line 155 which defines a second tab 156 disposed adjacent to the second cutaway R2.

The blank 110 comprises a handle structure defined in part in the first top panel 114 and in part in the second top panel 122. The handle structure comprises a first handle aperture HA1 struck from the first top panel 114. The handle structure comprises a second handle aperture HA2 struck from the second top panel 122.

The first top panel 114 comprises a first cushioning flap 160 hinged to the first top panel 114 by a fold line 161. The fold line 161 defines an edge of the first handle aperture HA1 when the first cushioning flap 160 is folded out of the plane of the first top panel 114. The second top panel 122 comprises a second cushioning flap 162 hinged to the second top panel 122 by a fold line 163. The fold line 163 defines an edge of the second handle aperture HA2 when the second cushioning flap 162 is folded out of the plane of the second top panel 122. The first and second handle apertures HA1, HA2 are configured and arranged such that when the first top panel 114 is disposed in partial overlapping relationship with the second top panel 122, the first and second handle apertures HA1, HA2 define a handle strap therebetween.

The blank 110 comprises an aperture A1 struck from the ninth end closure panel 132*b*. The aperture A1 interrupts the fold line 133*b*. The aperture A1 may be employed by a user to slide or withdraw the carton 190 from a stack of similar cartons 190.

The first side panel 116 comprises a first plurality of lines of severance 170, 172, 174. The second side panel 120 comprises a second plurality of lines of severance 171, 173, 175. The first plurality of lines of severance 170, 172, 174 together with the second plurality of lines of severance 171, 173, 175 and the first and second lines of severance 141, 151 define a removable corner portion CP (see FIG. 20) for forming a dispenser D for the articles C.

The first plurality of lines of severance 170, 172, 174 includes a third line of severance 170, fourth line of severance 172 and a fifth line of severance 174. The third line of severance 170 initiates at the fold line 129*a* hinging the second end closure panel 128*a* to the first side panel 116. The third line of severance 170 terminates at a first aperture A2. Preferably first aperture A2 is substantially triangular in shape. Preferably, the third line of severance 170 terminates at first corner of the triangular first aperture A2. The first aperture A2 is struck from the first side panel 116. The fourth line of severance 172 initiates at the first aperture A2. Preferably, the fourth line of severance 172 initiates at second corner of the triangular first aperture A2. The fourth line of severance 172 terminates at the fold line 115 hinging the first top panel 114 to the first side panel 116. The fourth line of severance 172 terminates at the fold line 115 proximate the line of severance 176 coupling the transition panel 144 to the first top panel 114 so as to be contiguous therewith. The fifth line of severance 174 initiates at the first aperture A2 and terminates at the fold line 115 hinging the first top panel 114 to the first side panel 116. Preferably, the fifth line of severance 174 initiates at a third corner of the triangular first aperture A2. The fifth line of severance 174 terminates at the fold line 115 proximate the fold line 143 hinging the first corner panel 142 to the first transition panel 144 so as to be contiguous therewith.

The second plurality of lines of severance 171, 173, 175 includes a sixth line of severance 171, seventh line of severance 173 and an eighth line of severance 175. The sixth line of severance 171 initiates at the fold line 133*a* hinging the fourth end closure panel 132*a* to the second side panel 120. The sixth line of severance 171 terminates at a second aperture A3. Preferably second aperture A3 is substantially triangular in shape. Preferably, the sixth line of severance 171 terminates at first corner of the triangular second aperture A3. The second aperture A3 is struck from the second side panel 120. The seventh line of severance 173 initiates at the second aperture A3. Preferably, the seventh line of severance 173 initiates at second corner of the triangular second aperture A3. The seventh line of severance 173 terminates at the fold line 121 hinging the second top panel 122 to the second side panel 120. The seventh line of severance 173 terminates at the fold line 121 proximate the line of severance 177 coupling the second transition panel 154 to the second top panel 122 so as to be contiguous therewith. The eighth line of severance 175 initiates at the second aperture A3 and terminates at the fold line 121 hinging the second top panel 122 to the second side panel

120. Preferably, the eighth line of severance 175 initiates at a third corner of the triangular second aperture A3. The eighth line of severance 175 terminates at the fold line 121 proximate the fold line 153 hinging the second corner panel 152 to the second transition panel 154 so as to be contiguous therewith.

The blank 110 comprises a tear feature comprising the first severable line 131*a*, a second severable line 117A and a third severable line 119*a*. The first severable line 131*a* couples the third end closure panel 130*a* to the bottom panel 118 and also serves as a fold line. The second severable line 117A extends along a portion of the fold line 117 and is collinear therewith. The third severable line 119*a* extends along a portion of the fold line 119 and is collinear therewith. The first severable line 131*a* is interrupted by a tear initiation feature 165 formed as a frangible line including a cutline interrupted by connecting nicks. In this way the tear initiation feature 165 is more easily severed than the first severable line 131*a*, the second severable line 117A and the third severable line 119*a*. The tear feature allows a portion of the bottom panel 118 to be severed from the carton 190 to form a door or gateway. The tear feature may be employed in conjunction with a dispenser apparatus (not shown) such that when the carton 190 is inserted into the dispenser apparatus the tear feature is automatically severed thereby forming an opening for allowing articles C to pass through.

Figure 14:
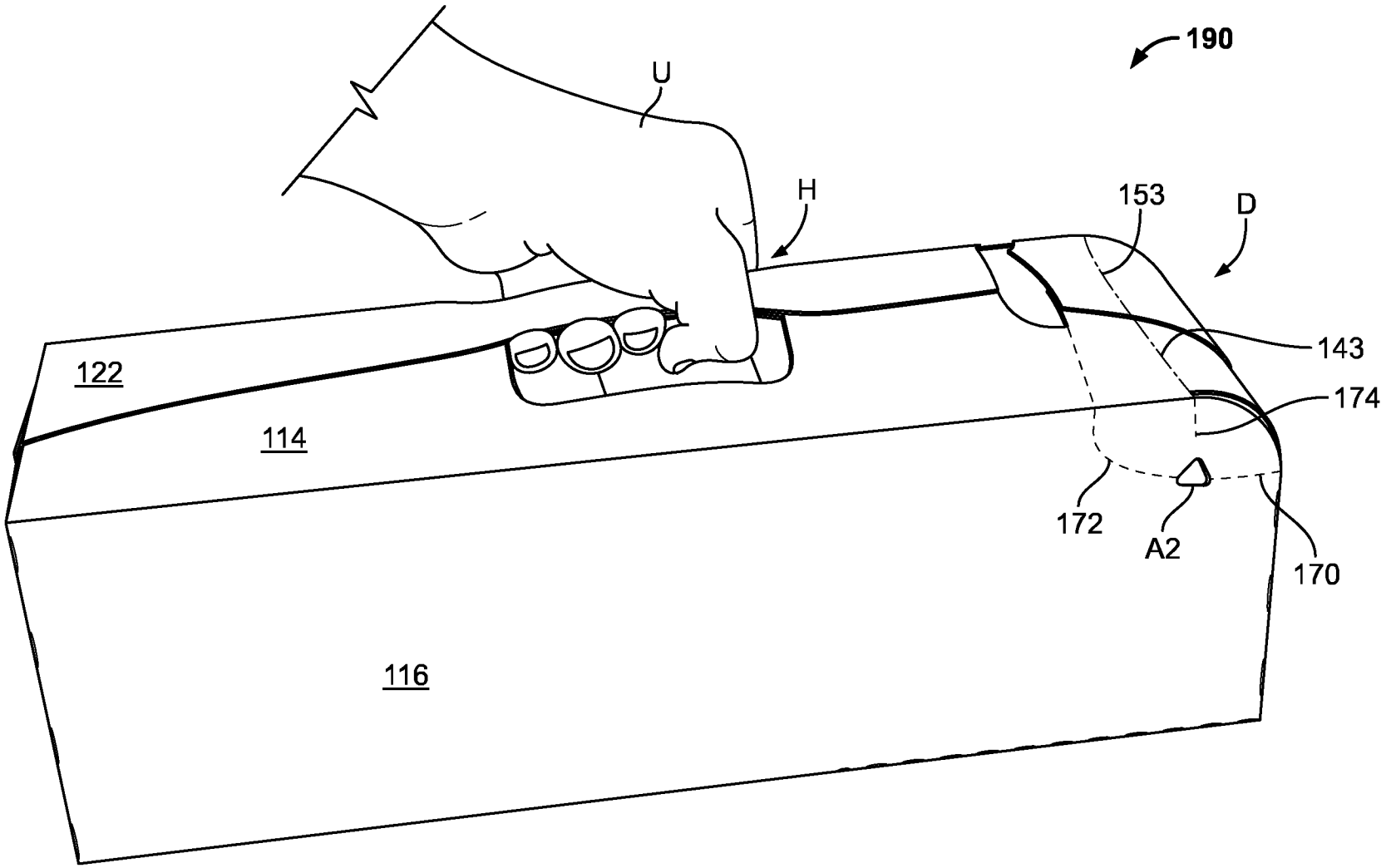
FIG. 14 is a perspective view from above of a carton formed from the blank of FIG. 13.

Turning to the construction of the carton 190 as illustrated in FIG. 14, the carton 190 can be formed by a series of sequential folding operations in a straight line machine so that the carton 190 is not required to be rotated or inverted to complete its construction. The folding process is not limited to that described below and may be altered according to particular manufacturing requirements.

Glue or other adhesive treatment is applied to the handle reinforcing panel 112 or, in alternative embodiments, to a corresponding portion of the first top panel 114.

The handle reinforcing panel 112 is folded about the fold line 113 to overlie the first top panel 114. The handle reinforcing panel 112 is secured to the first top panel 114. The first top panel 114 and the first side panel 116 are folded about the fold line 117 such that the first side panel 116 overlies the bottom panel 118 and the first top panel 114 overlies the second side panel 120.

The sixth end closure panel 126*b* is placed in partial overlapping relationship with the tenth end closure panel 134*b* and is secured thereto by glue or other suitable adhesive treatment.

The first end closure panel 126*a* is placed in partial overlapping relationship with the fifth end closure panel 134*a* and is secured thereto by glue or other suitable adhesive treatment.

Glue or other adhesive treatment is applied to the first top panel 114 and/or to a corresponding area of the second top panel 122. The second top panel 122 is secured to the first top panel 114 to form a flat collapsed tubular structure. This flat collapsed tubular structure can be shipped or transported to a converter plant. At the converter plant the flat collapsed tubular structure is opened and erected to form a tubular structure having a substantially square or rectangular cross-sectional shape.

The erected tubular structure is loaded with articles through one or both open ends. One or more of the end closure panels 126*a*, 128*a*, 130*a*, 132*a*, 134*a*, 126*b*, 128*b*, 130*b*, 132*b*, 134*b* may be folded outwardly to act as a funnel to facilitate insertion of the articles into the carton 190.

Once the articles are loaded into the tubular structure the ends of the tubular structure are closed.

A first end of the tubular structure is closed by folding the first and fifth end closure panels 126*a*, 134*a* so as to deform the first and fifth end closure panels 126*a*, 134*a* into a curved or arcuate shape. The third end closure panel 130*a* is folded about severable line 131*a*.

Glue or other adhesive treatment is applied to an outer surface of the first and fifth end closure panels 126*a*, 134*a* and to the third end closure panel 130*a*. In alternative embodiments the glue or adhesive treatment is applied to an inner surface of the corresponding region of the second and fourth end closure panels 128*a*, 132*a*. The second end closure panel 128*a* is then folded about the fold line 129*a* and is secured to the first and fifth end closure panels 126*a*, 134*a* and to the third end closure panel 130*a*.

Glue or adhesive treatment is applied to an outer surface of the second end closure panel 128*a* and/or to an inner surface of the fourth end closure panel 132*a*. The fourth end closure panel 132*a* is folded about fold line 133*a* and brought into contact with the second end closure panel 128*a* such that part of the fourth end closure panel 132*a* is in overlapping relationship with part of the second end closure panel 128*a* and is secured and affixed thereto. The second end closure panel 128*a* and the fourth end closure panel 132*a* are secured to the first and fifth end closure panels 126*a*, 134*a*. The first and second securing panels 140, 150 are secured to the second end closure panel 128*a* and the fourth end closure panel 132*a*.

A second end of the tubular structure is closed by folding the sixth and tenth end closure panels 126*b*, 134*b* about fold lines 127*b*, 135*b* and by folding the eighth end closure panel 130*b* about fold line 131*b*.

Glue or other adhesive treatment may be applied to an outer surface of the sixth and tenth end closure panels 126*b*, 134*b* and to an outer surface of the eighth end closure panel 130*b*. In alternative embodiments the glue or adhesive treatment is applied to an inner surface of the corresponding region of the seventh and ninth end closure panels 128*b*, 132*b*.

The seventh end closure panel 128*b* is folded about the fold line 129*b* and in some embodiments secured to the sixth and tenth end closure panels 126*b*, 134*b* and to the eighth end closure panel 130*b*.

Glue or adhesive treatment is applied to an outer surface of the seventh end closure panel 128*b* or to an inner surface of the ninth end closure panel 132*b*. The ninth end closure panel 132*b* is folded about fold line 133*b* and brought into contact with the seventh end closure panel 128*b* such that a portion of the ninth end closure panel 132*b* is in overlapping relationship with a portion of the seventh end closure panel 128*b* and is secured thereto.

In some embodiments one end of the tubular structure may be closed before loading articles through a remaining open end of the tubular structure.

FIG. 14 shows the carton 190 constructed from the blank 110; a user U is engaging the handle structure H formed in the composite top panel 114, 122 formed from the first and second top panels 114, 122.

Figure 15:
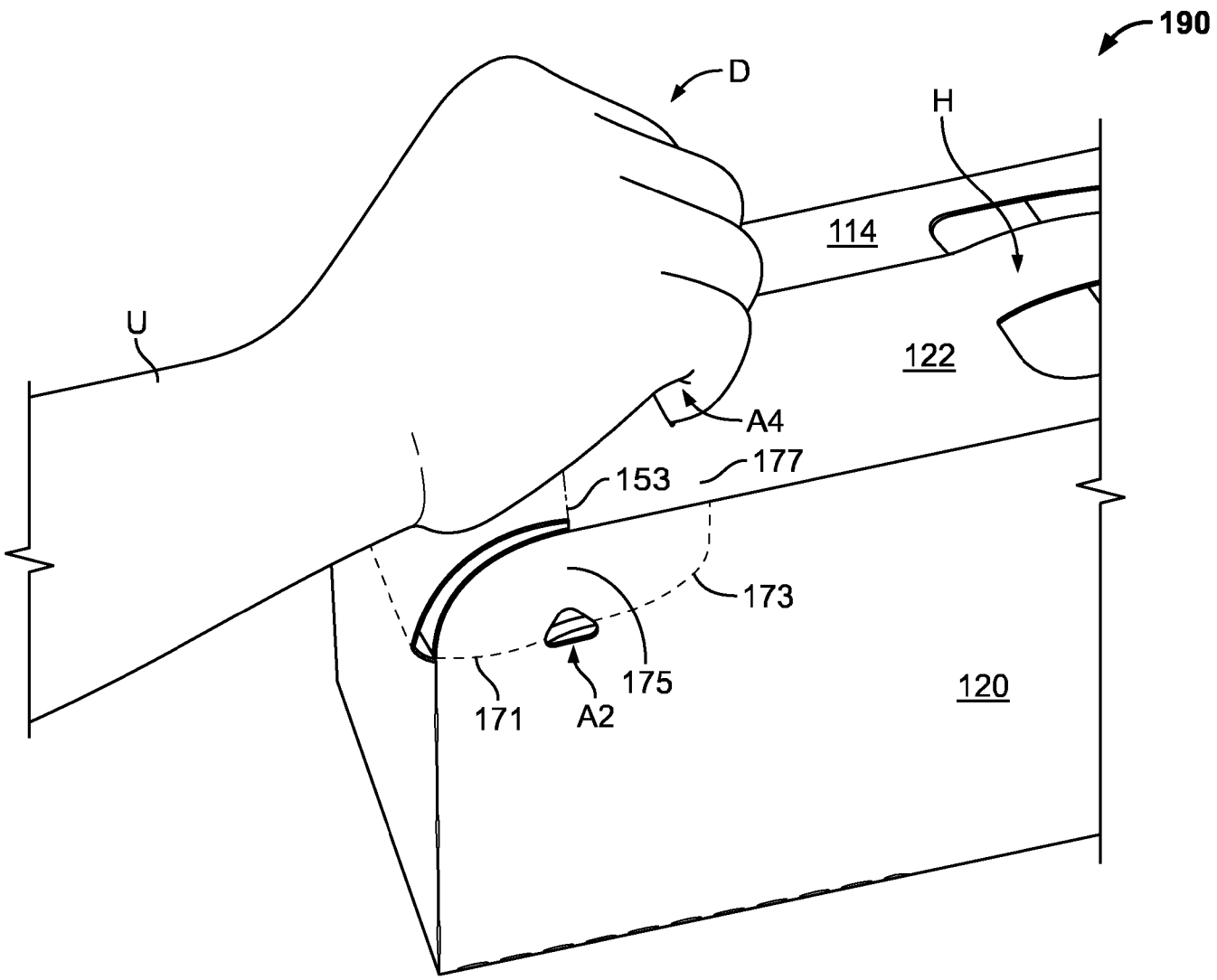
FIGS. 15 to 20 are perspective views from above of an end portion of the carton formed from the blank of FIG. 13 showing deployment of a dispenser.

FIGS. 15 to 20 illustrate a user U removing a corner portion CP of the carton 190 to create a dispenser D. Referring to FIG. 15 a user U inserts one or more fingers through an opening in the composite top panel 114,122 formed by the first and second recesses R1, R2 and by inwardly folding the first and second tabs 146, 156 about fold lines 145, 155 (see FIG. 13).

Figure 12:
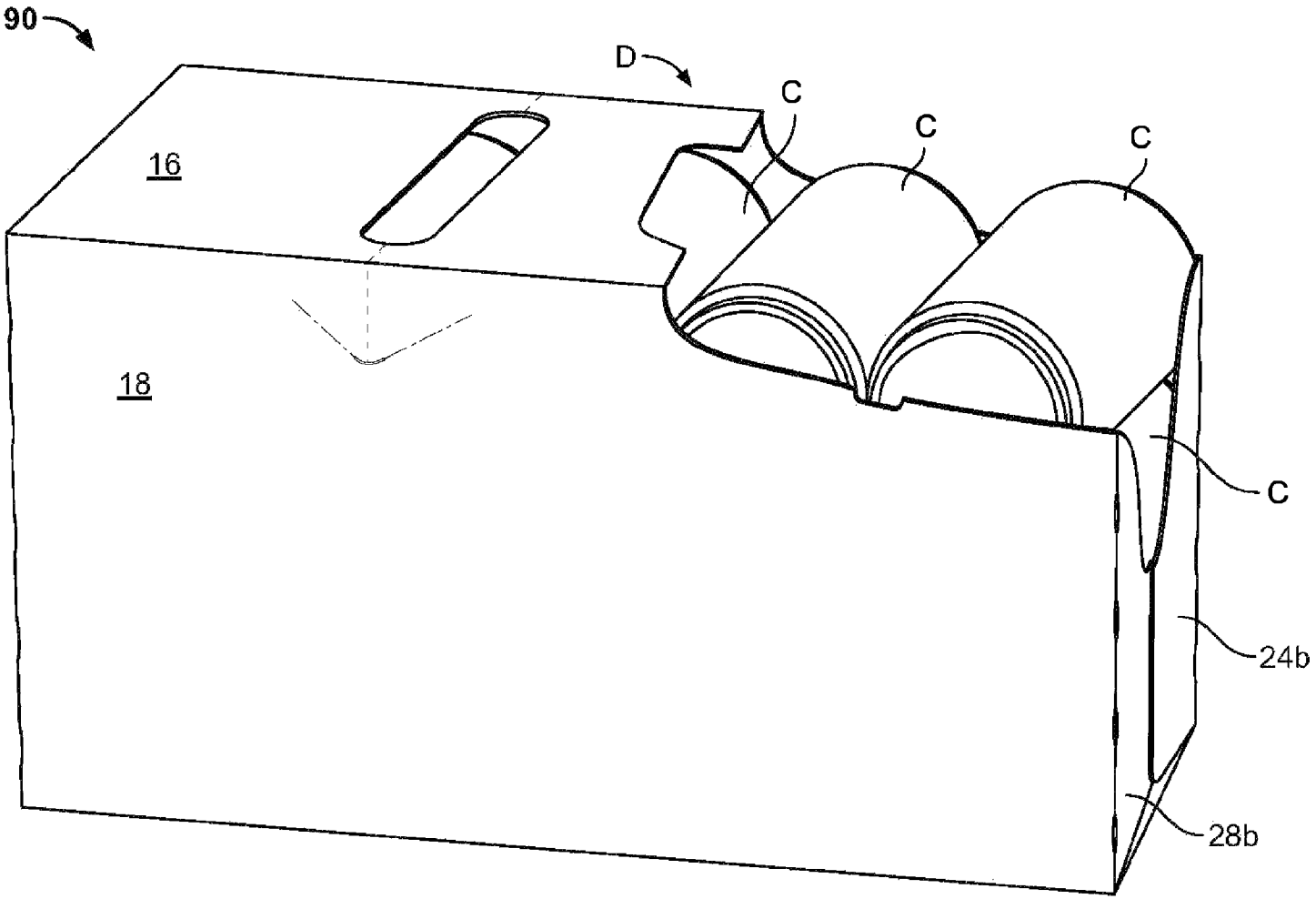
FIG. 12 is a perspective view from above of a carton formed from the blank of FIG. 1 in which a corner portion of the carton has been removed to gain access to the carton contents.
Figure 16:
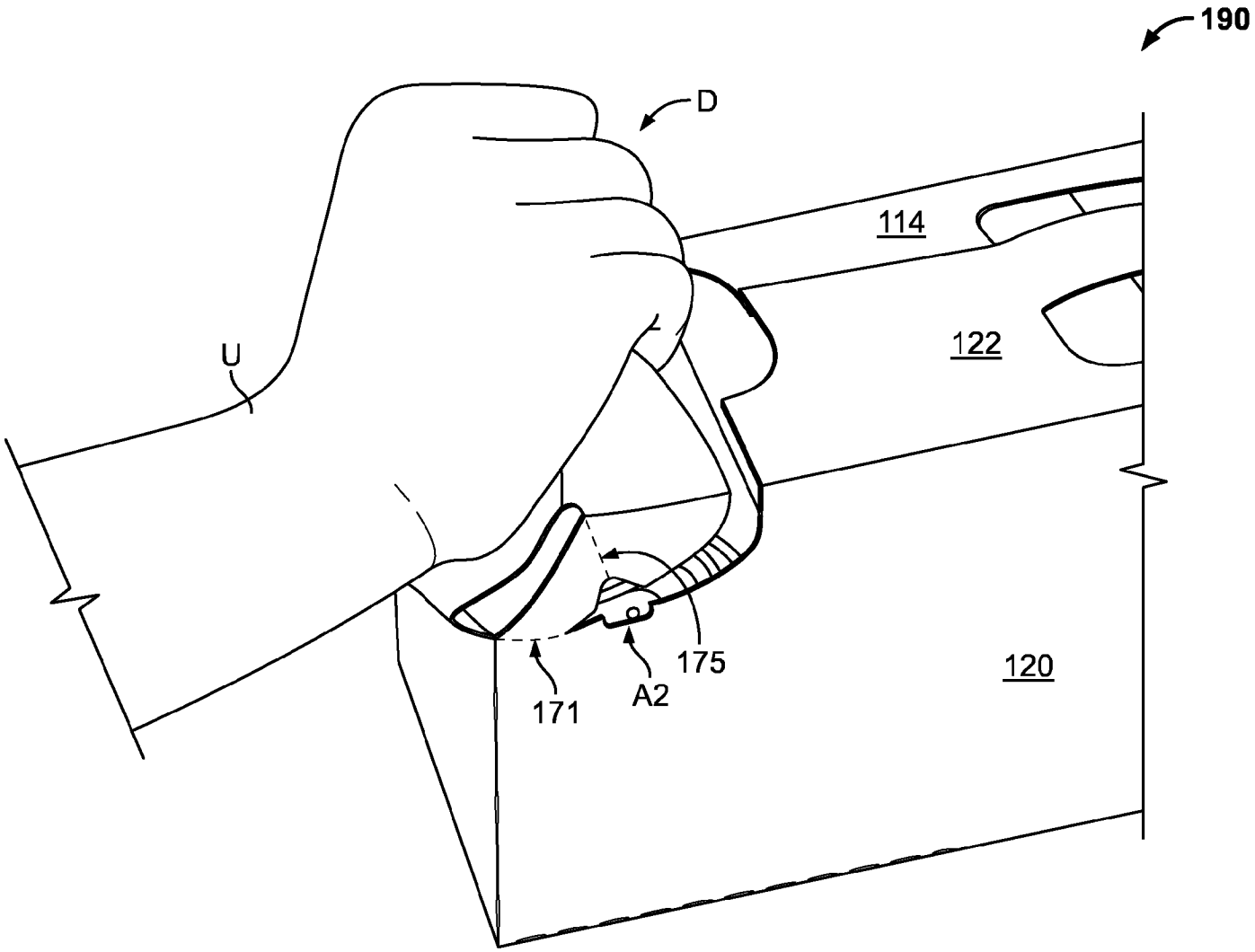

The user U then pulls the corner portion CP upwardly and away from the centre of the carton 190 to sever the lines of severance 176, 177 in the composite top panel 114,122. The user U continues to pull the corner portion CP such that the tear propagates into the first and second side walls 116, 120; the fourth line of severance 172 and the seventh line of severance 173 are severed or broken until the tear reaches each of the first and second apertures A2, A3. Once the tear reaches the first and second apertures A2, A3, those apertures A2, A3 direct or channel the tear into the third line of severance 170 and the sixth line of severance 171. The portions of the corner portion CP formed from the first and second side panels 116, 120 deform or fold about the fifth line of severance 174 and the eighth line of severance 175. The first and second side panels 116, 120 proximate the first plurality of lines of severance 170, 172, 174 and the second plurality of lines of severance 171, 173, 175 are deformed or displaced either inwardly (as shown in FIG. 16) or outwardly. This allows the tear to propagate more easily into the third and sixth lines of severance 170, 171 through the first and second side panels 116, 120. The tear does not propagate into the fifth and eighth lines of severance 174, 175 in the second embodiment primarily because of the size of the corner portion CP which is designed to define a dispensing/access opening (or dispenser) which is substantially smaller than the one illustrated in FIGS. 10 to 12 of the first embodiment. The access opening shown in FIGS. 10 to 12 is about the size of two cans whereas the opening, as illustrated in FIGS. 17 to 20 is about the size of one can. However, if the corner portion CP in the second embodiment were as large as that of the first embodiment, the tear may first develop into the fifth and eighth lines of severance 174, 175 from the apertures A1, A2 before it propagates into the third and sixth lines of severance 170, 171.

Figure 17:
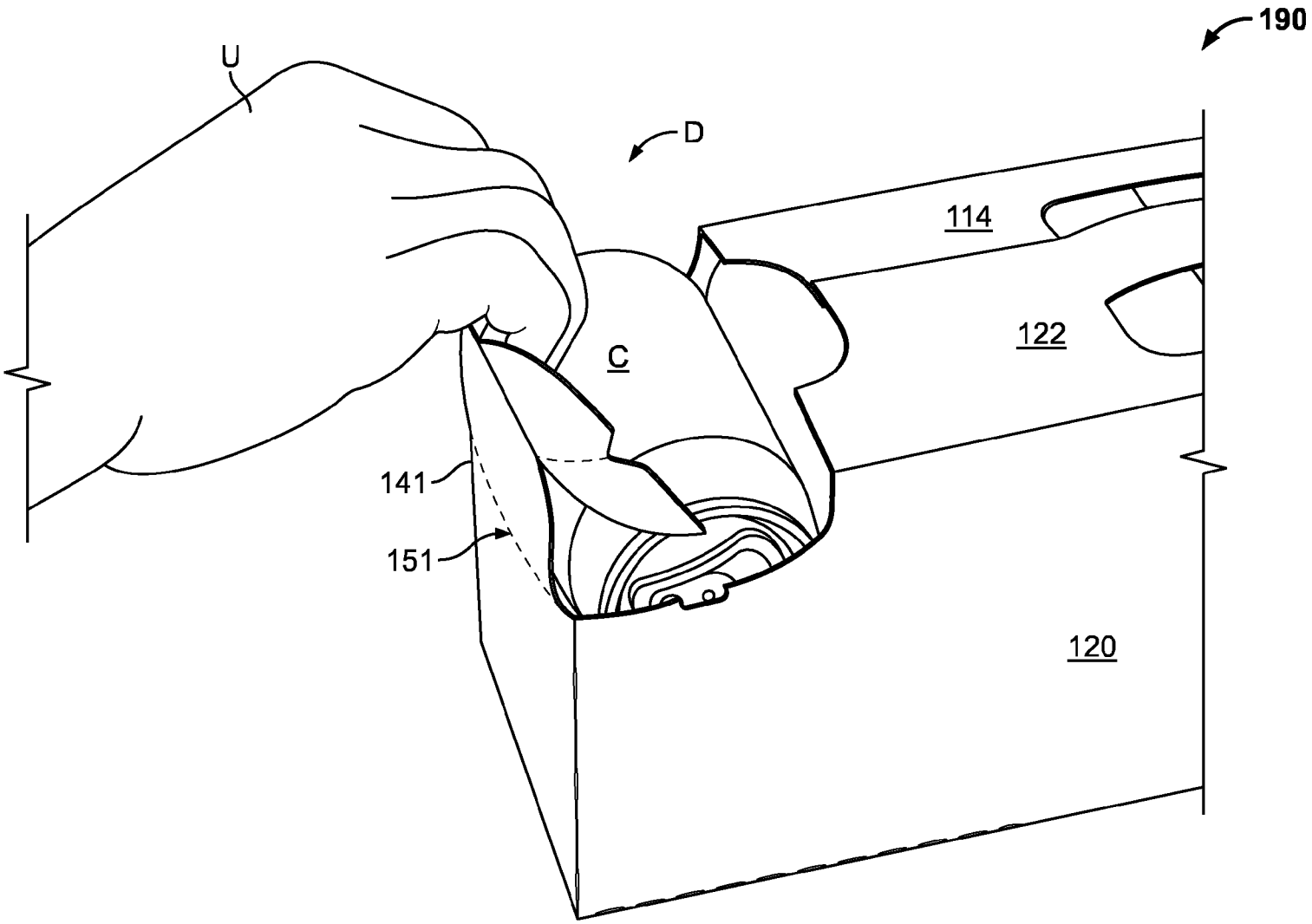
Figure 18:
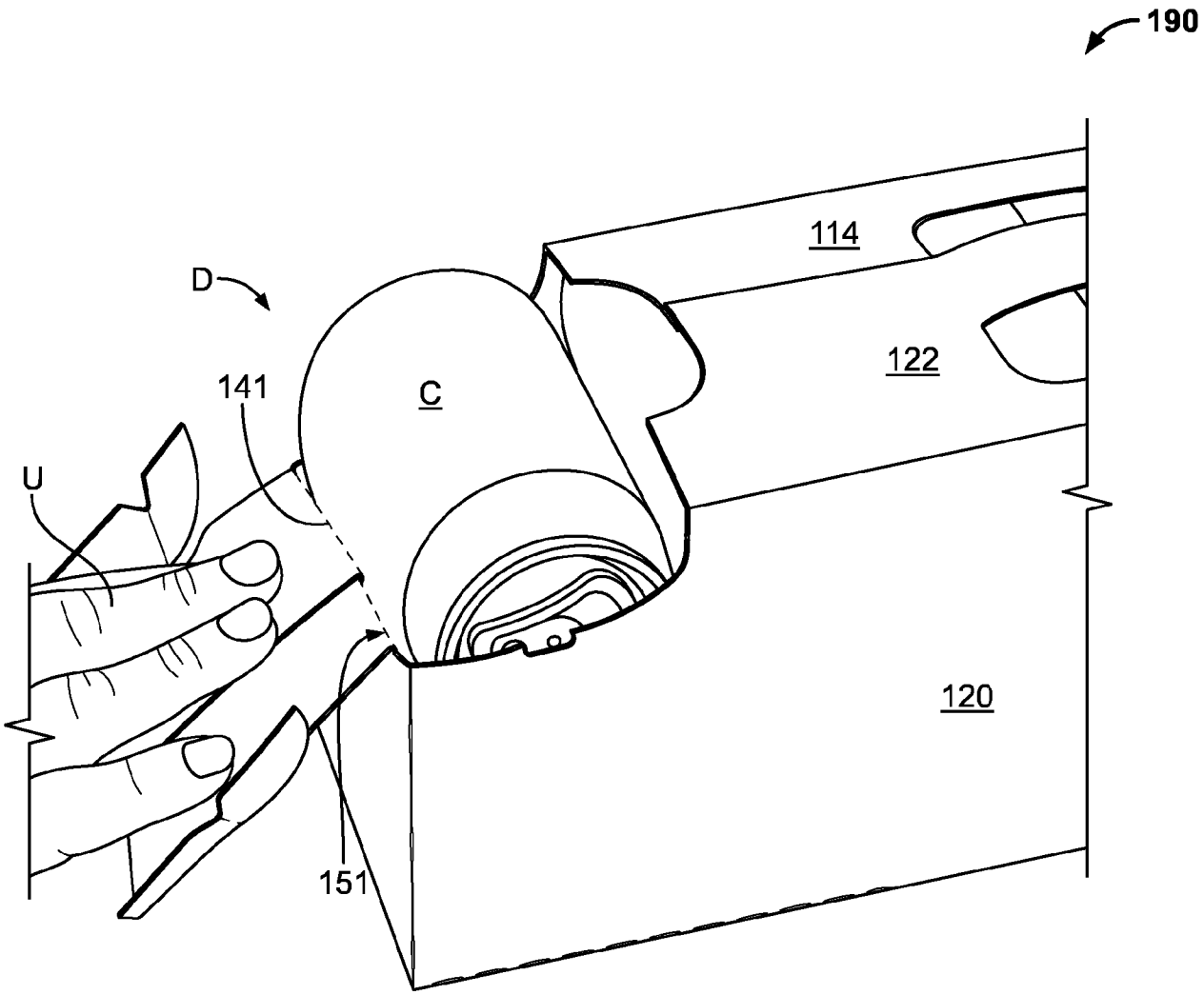
Figure 19:
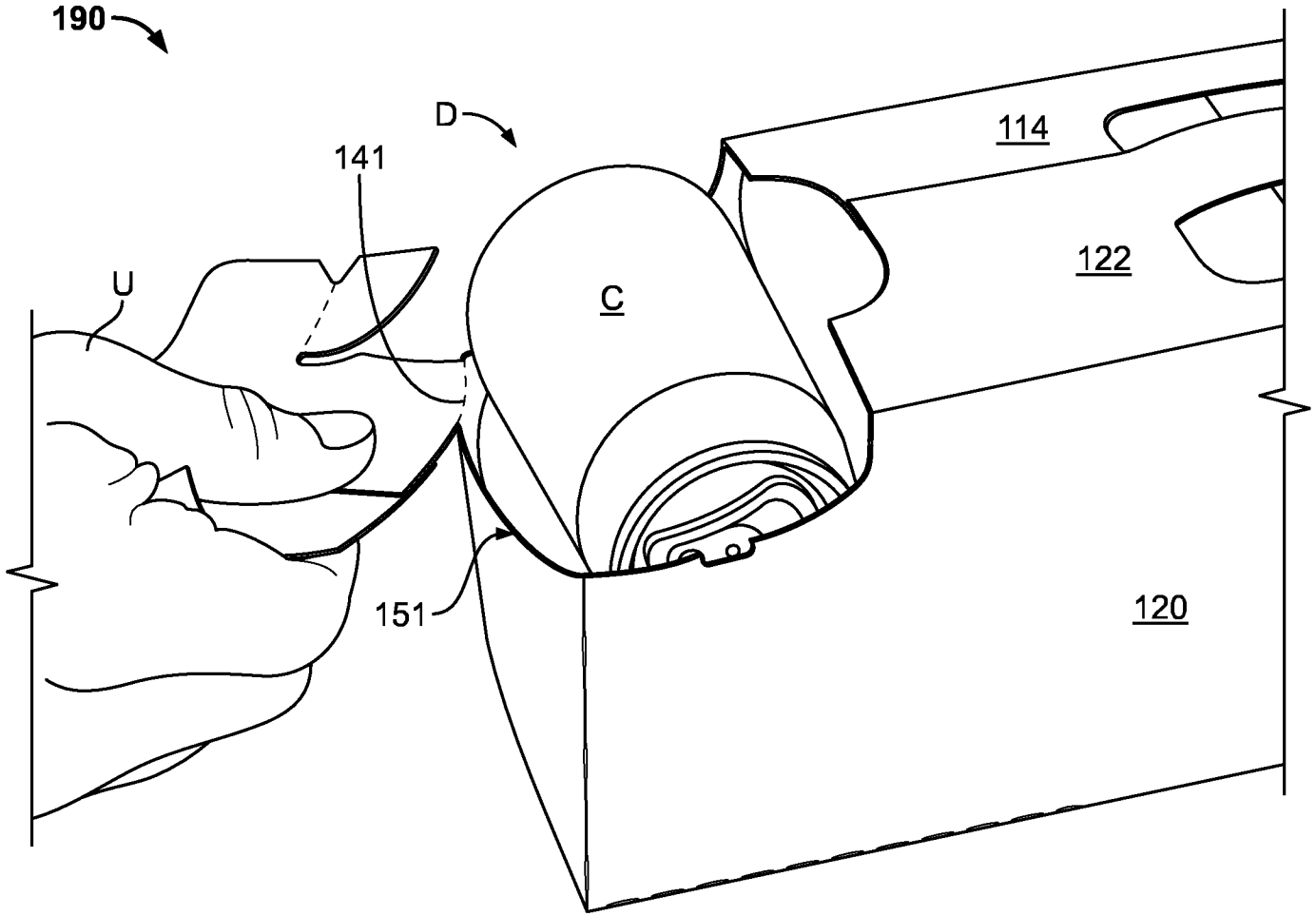
Figure 20:
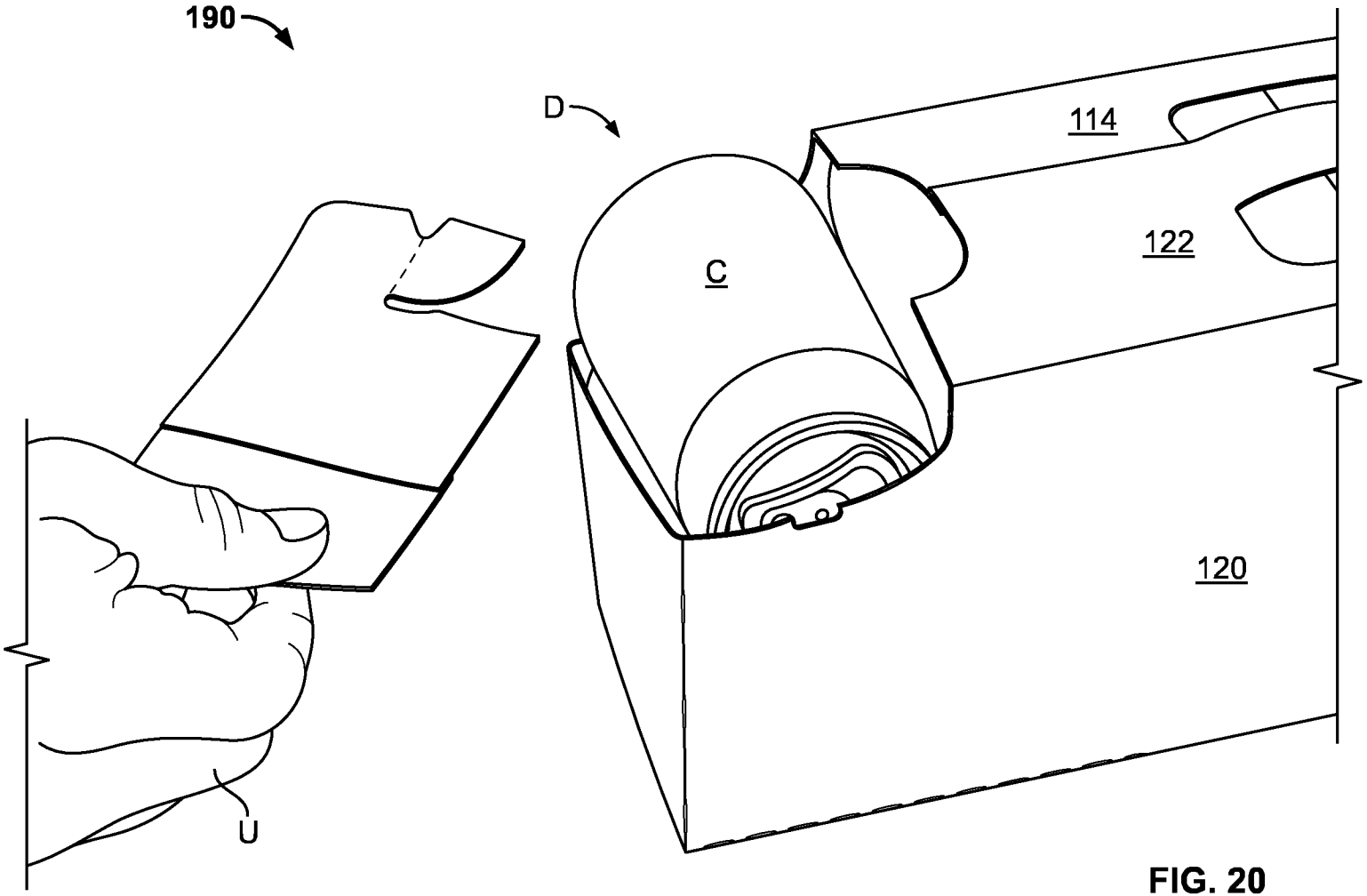

Once the breaking of the third and sixth lines of severance 170, 171 is completed as shown in FIG. 17, the user U folds the corner portion CP about the first line of severance 141 and the second line of severance 151, as shown in FIG. 18. The user U then tears the corner portion CP away from the carton 190 by severing the first line of severance 141 and second line of severance 151, as shown in FIGS. 19 and 20. In this way an endmost article C in the upper row of the carton 190 is exposed to view and can be readily removed by the user U. The first line of severance 141 and second line of severance 151 are arranged so as to be in registry or alignment with an upper edge of the second and fourth end closure panels 128*a*, 132*a*. In this way, the upper edge of the second and fourth end closure panels 128*a*, 132*a* create a shearing barrier or guide edge for assisting a user U to tear the corner portion CP away from the carton 190.

Figure 21:
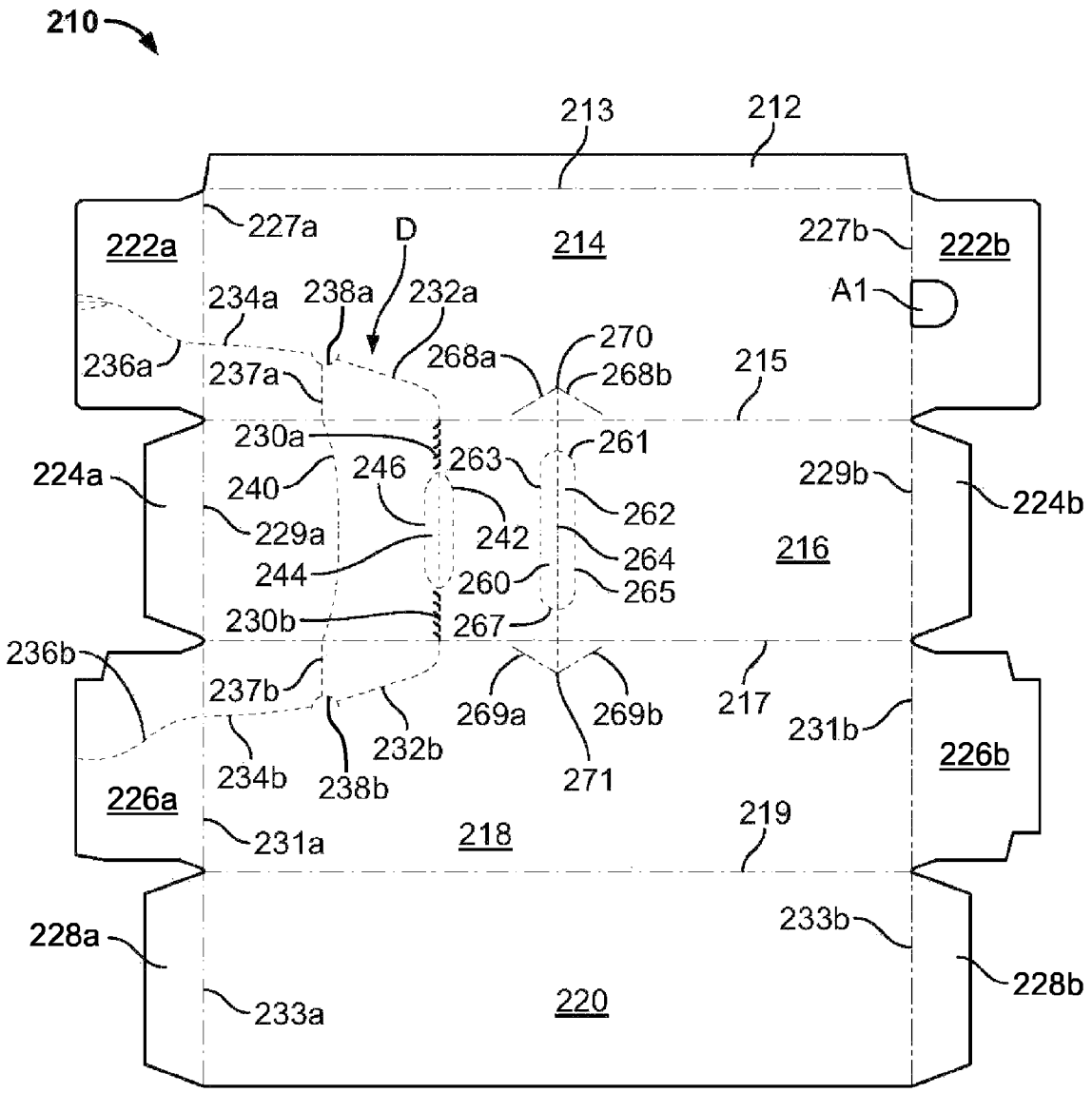
FIG. 21 is a plan view from above of a blank for forming a carton according to a third embodiment of the invention.
Figure 22:
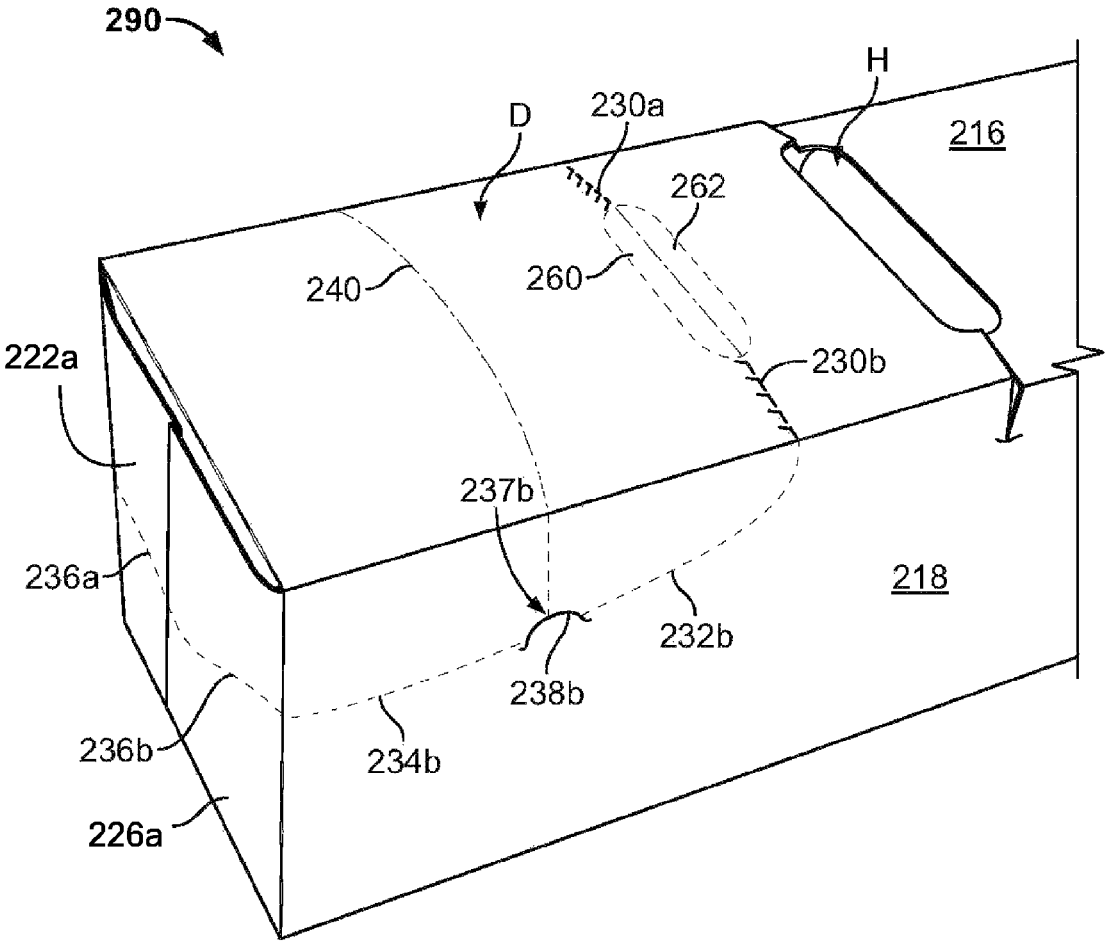
FIG. 22 is a perspective view from above of an end portion of a carton formed from the blank of FIG. 21.
Figure 23:
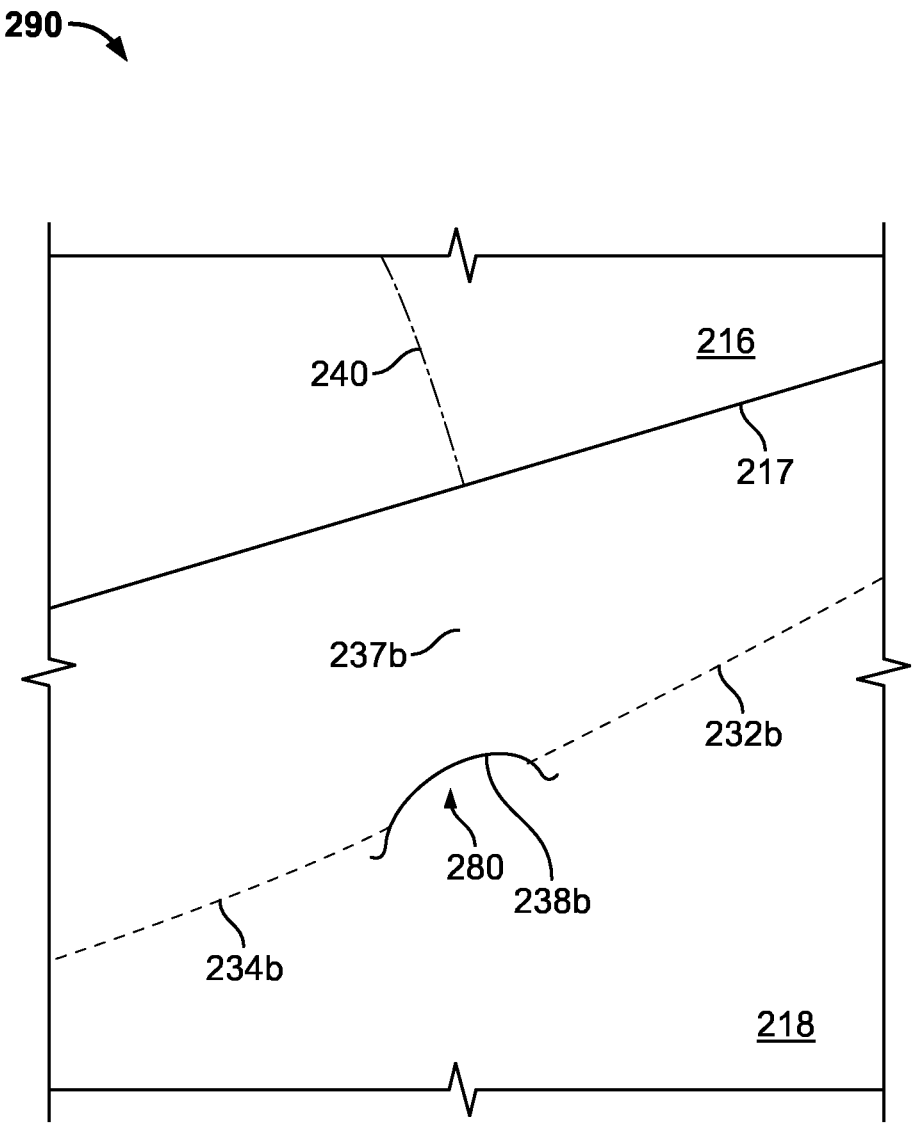
FIG. 23 is an enlarged perspective view of a portion of the carton of FIG. 22.

FIG. 21 shows a blank 210 for forming a carton 290 according to a third embodiment of the invention.

The blank 210 comprises a plurality of main wall panels 214, 216, 218, 220 including; a bottom panel 220, a first side panel 214, a top panel 216 and a second side panel 218. A glue panel 212 is hinged to the first side panel 214 along a fold line 213; in other embodiments the glue panel 212 may be hinged to the bottom panel 220. The first side panel 214 is hinged to the first top panel 216 by a fold line 215. The top panel 216 is hinged to the second side panel 218 by a fold line 217. The second side panel 218 is hinged to the bottom panel 220 by a fold line 219.

The plurality of main panels 214, 216, 218, 220 form a tubular structure in a set-up condition. Each of the ends of the tubular structure are at least partially closed by end closure panels 222*a*, 224*a*, 226*a*, 228*a*, 222*b*, 224*b*, 226*b*, 228*b*. End closure panels 222*a*, 224*a*, 226*a*, 228*a* are configured to close a first end of the tubular structure and end panels 222*b*, 224*b*, 226*b*, 228*b* are configured to close a second end of the tubular structure.

A first end closure panel 222*a* is hinged to a first end of first side panel 214 by a fold line 227*a*. A second end closure panel 224*a* is hinged to a first end of top panel 216 by a fold line 229*a*. A third end closure panel 226*a* is hinged to a first end of second side panel 218 by a fold line 231*a*. A fourth end closure panel 228*a* is hinged to a first end of the bottom panel 220 by a fold line 233*a*.

A fifth end closure panel 222*b* is hinged to a second end of first side panel 214 by a fold line 227*b*. A sixth end closure panel 224*b* is hinged to a second end of top panel 216 by a fold line 229*b*. A seventh end closure panel 226*b* is hinged to a second end of second side panel 218 by a fold line 231*b*. An eighth end closure panel 228*b* is hinged to a second end of the bottom panel 220 by a fold line 233*b*.

The blank 210 comprises a handle structure substantially similar in construction to that described above with reference to the first embodiment shown in FIG. 1 and will not be described in more detail here.

Figure 24:
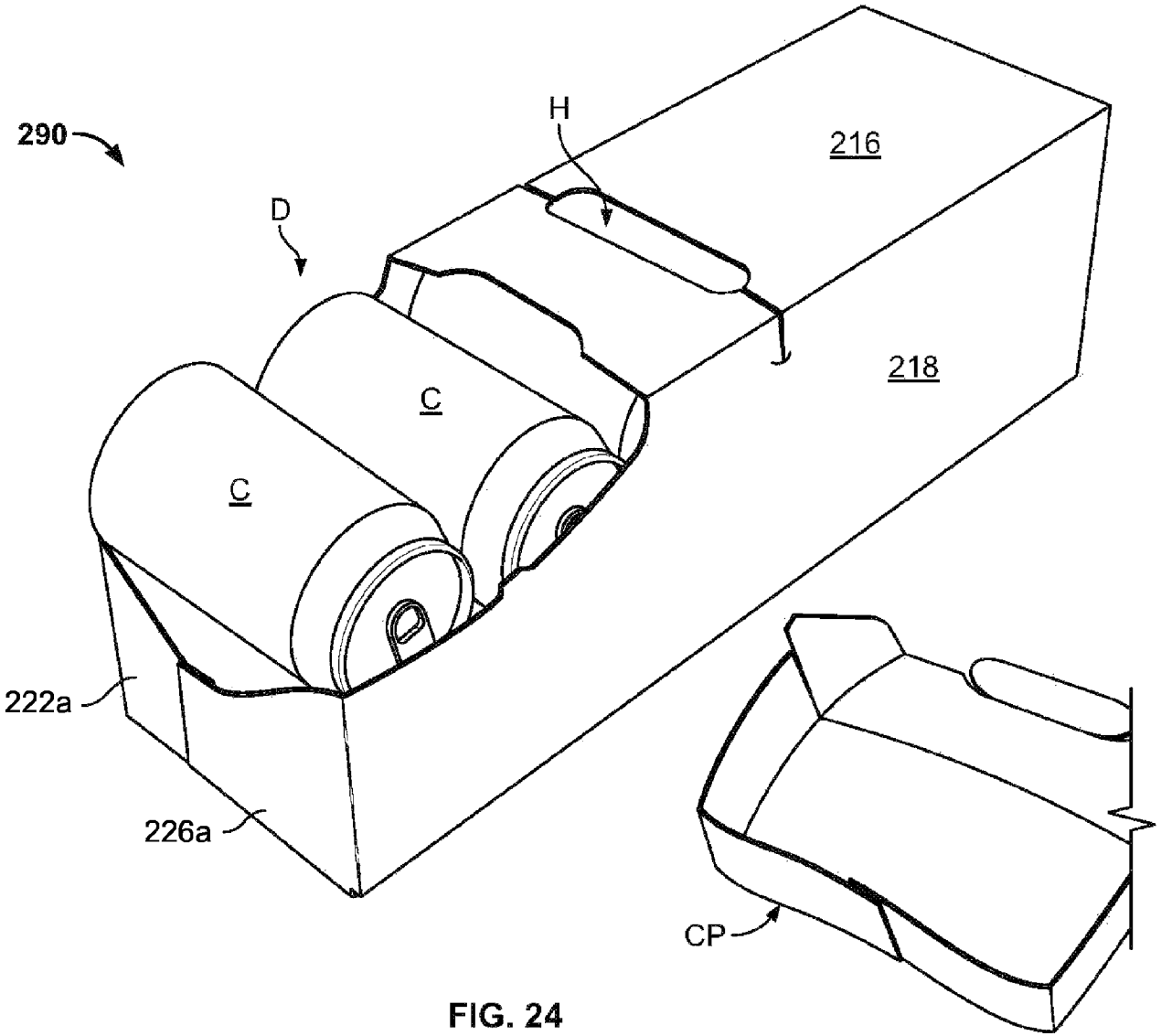
FIG. 24 is a perspective view from above of a carton formed from the blank of FIG. 21 showing deployment of a dispenser.

An access device D is provided for removal of a corner portion CP of the carton 290 (see FIG. 24). Removal of the corner portion CP separates a portion of the top panel 216 from the carton 290. Removal of the corner portion CP also separates a portion of each of the first and second side walls 214, 218 and a portion of the end wall formed by the end closure panels 222*a*, 224*a*, 226*a*, 228*a*.

The access device D comprises a plurality of lines of severance, including a first line of severance 236*a* which extends across the first end closure panel 222*a* and is contiguous with a second line of severance 234*a* defined in the first side wall 214, best shown in FIG. 21. The second line of severance 234*a* extends across the first side wall 214 to meet a first arcuate cutline or line of severance 238*a* struck from the first side wall 214. A third line of severance 232*a* extends from the first arcuate cutline or line of severance 238*a* across the first side wall 214 to meet the fold line 215 between the top panel 216 and the first side wall 214.

The access device D further comprises a fourth line of severance 236*b*, which extends across the third end closure panel 226*a* and is contiguous with a fifth line of severance 234*b* defined in the second side wall 218. The fifth line of severance 234*b* extends across the second side wall 218 to meet a second arcuate cutline or line of severance 238*b* struck from the second side wall 218. A sixth line of severance 232*b* extends from the second arcuate cutline or line of severance 238*b* across the second side wall 218 to meet the fold line 217 between the top panel 216 and the second side wall 218.

The access device D further comprises a seventh line of severance 230*a* which extends transversely partially across the top panel 216. The seventh line of severance 230*a* is arranged to be contiguous with the third line of severance 232*a*.

The access device D still further comprises an eighth line of severance 230*b* which extends transversely partially across the top panel 216. The eighth line of severance 230*b* is arranged to be contiguous with the sixth line of severance 232*b*. The seventh line of severance 230*a* and eighth line of severance 230*b* are arranged to be collinear with each other.

The seventh and eighth lines of severance 230*a*, 230*b* may be continuous with one another. In such an embodiment, the first, second, third, fourth, fifth, sixth, seventh and eighth lines of severance 236*a*, 234*a*, 232*a*, 236*b*, 234*b*, 232*b*, 230*a*, 230*b* provide primary lines of severance respectively, along which the corner portion CP may be removed from the carton 290.

In an alternative embodiment, the access device D may further comprise an optional finger engagement or tear initiation device. The tear initiation device comprises a tab 244 defined in the top panel 216. The tab 244 is defined in part by a fold line 246. Tab 244 interrupts the seventh and eighth lines of severance 230*a*, 230*b*. Preferably, seventh and eighth lines of severance 230*a*, 230*b* and fold line 246 are collinear. The tab 244 is defined in part by a ninth line of severance 242. Ninth line of severance 242 is substantially "U" shaped and comprises a first and a second end, each of which is adjacent to or contiguous with a respective end of the seventh and eighth lines of severance 230*a*, 230*b*. In this alternative embodiment, the first, second, third, fourth, fifth, sixth, seventh, eighth and ninth lines of severance 236*a*, 234*a*, 232*a*, 236*b*, 234*b*, 232*b*, 230*a*, 230*b*, 242 provide primary lines of severance respectively, along which the corner portion CP may be removed from the carton 290.

A further optional fold line is provided across the tab 244 and extends transversely with respect to a tubular axis of the set-up carton 290. The further optional fold line divides the tab 244 into a first part and a second part.

The access device D comprises a fold line 240 extending transversely across the top panel 216. Optionally, the fold line 240 is arcuate or curved. Preferably, the fold line 240 is concave when viewed from the end of the carton 290 which is closed by the end closure panels 222*a*, 224*a*, 226*a*, 228*a*. The access device D also comprises a tenth line of severance 237*a*. The tenth line of severance 237*a* extends from the first arcuate cutline or line of severance 238*a* across the first side panel 214. The tenth line of severance 237*a* is disposed substantially parallel to the fold line 227*a* between the first side panel 214 and the first end closure panel 222*a*. The tenth line of severance 237*a* is disposed substantially perpendicularly to the fold line 215 between the first side panel 214 and the top panel 216.

The access device D also comprises an eleventh line of severance 237*b*. The eleventh line of severance 237*b* extends from the second arcuate cutline or line of severance 238*b* across the second side panel 218. The eleventh line of severance 237*b* is disposed substantially parallel to the fold line 231*a* between the second side panel 218 and the third end closure panel 226*a*. The eleventh line of severance 237*b* is disposed substantially perpendicularly to the fold line 217 between the second side panel 218 and the top panel 216.

The tenth line of severance 237*a*, eleventh line of severance 237*b* and fold line 240 are arranged so as to be contiguous, such that they extend between the first arcuate cutline or line of severance 238*a* in the first side panel 214 and the second arcuate cutline or line of severance 238*b* in the second side panel 218. Stated differently, the tenth and eleventh lines of severance 237*a*, 237*b* provide first and second minor lines of severance respectively that are disposed continuously with the fold line 240 which is interposed between the minor lines of severance 237*a*, 237*b*.

The fold line 240 defines, in part, a first portion of the top panel 216 and, in part, a second portion of the top panel 216 which are detached when the corner portion CP is removed.

The first arcuate cutline or line of severance 238*a* and the second arcuate cutline or line of severance 238*b* are each an inverted "U" shape or semi-circle in the illustrated example; however other shapes may be employed such as, but not limited to, an inverted "V" shape.

The first arcuate cutline or line of severance 238*a* and the second arcuate cutline or line of severance 238*b* function, or are severable to function, to redirect the tear from the third and sixth lines of severance 232*a*, 232*b* into the tenth line and eleventh lines of severance 237*a*, 237*b* respectively; creating a pivot point allowing the pack to be readily opened. The advantage of using a die cut line instead of a cutout shape or aperture is that it allows for faster manufacturing speeds and a more aesthetically pleasing carton. Depending on the size of the corner portion CP, however, the arcuate cut lines 238*a*, 238*b* may redirect the tear differently. In an alternative embodiment where the corner portion CP is of about the size of one can, the arcuate cut lines may redirect the tear from the third and sixth lines of severance 232*a*, 232*b* directly into the second and fifth lines of severance 234*a*, 234*b* respectively. In such an alternative embodiment, the tenth and eleventh lines of severance 237*a*, 237*b* do not break but function as fold lines in the same way as lines of severance 174, 175 in the second embodiment.

Figure 25:
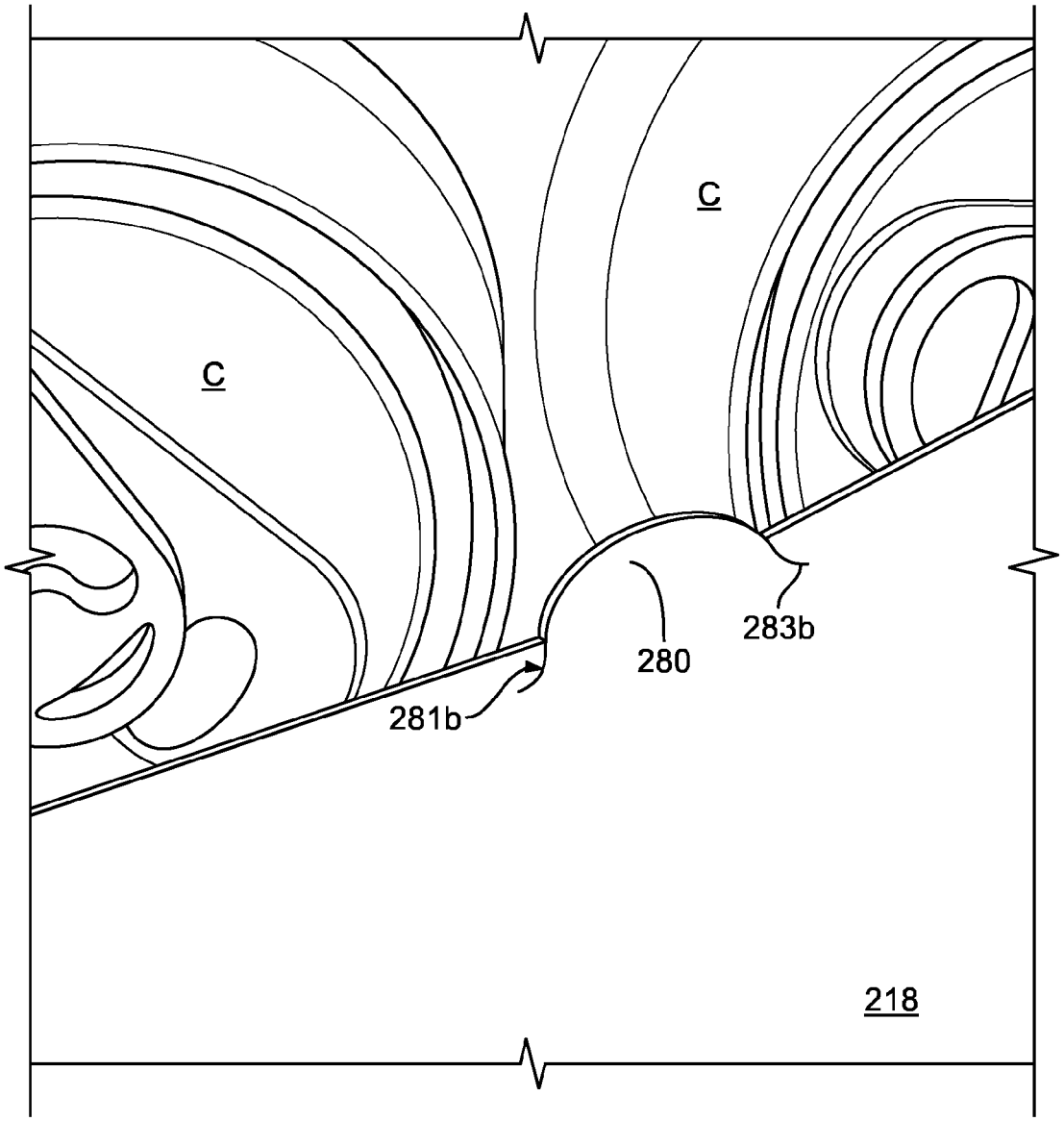
FIG. 25 is an enlarged perspective view of a portion of the carton of FIG. 24.

The first arcuate cutline or line of severance 238*a* and the second arcuate cutline or line of severance 238*b* each may comprise tail portions. FIG. 25 illustrates the tail portions 281*b*, 283*b* of the second arcuate cutline or line of severance 238*b*. The tail portions extend into the portion of the first or second side panel 214, 218 below the respective lines of severance 232*a*, 234*a*, 232*a*, 234*b*. The second arcuate cutline or line of severance 238*b* comprises first and second tail portions 281*b*, 283*b* as illustrated in FIG. 25.

The tail portions 281*b*, 283*b* are arcuate in shape and curl back toward the respective lines of severance 232*a*, 234*a*, 232*b*, 234*b* to prevent or at least mitigate against tears propagating into the first or second side panels 214, 218. In this way the tail portions 281*b*, 283*b* assist in keeping the tears "on track", that is to say propagating along the lines of severance 232*a*, 234*a*, 232*b*, 234*b*.

It can be appreciated that various changes may be made within the scope of the present invention. For example, the size and shape of the panels, walls and apertures may be adjusted to accommodate articles of differing size or shape.

It will be recognised that as used herein, directional references such as "top", "bottom", "front", "back", "end", "side", "inner", "outer", "upper" and "lower" do not necessarily limit the respective panels and/or walls to such orientation, but may merely serve to distinguish these panels and/or walls from one another.

As used herein, the terms "hinged connection" and "fold line" refer to all manner of lines that define hinge features of the blank, facilitate folding portions of the blank with respect to one another, or otherwise indicate optimal panel folding locations for the blank. A fold line is typically a scored line, an embossed line, or a debossed line. Any reference to "hinged connection" or "fold line" should not be construed as necessarily referring to a single fold line only; indeed it is envisaged that a hinged connection can be formed from any one or more of the following: a short slit, a frangible line or a fold line without departing from the scope of the invention.

As used herein, the terms "line of severance" and "severance line" each refers to all manner of lines formed in a substrate of sheet material that facilitate separating portions of the substrate from one another, or that indicate optimal separation locations on the substrate. The term "line of severance" defines a tear line, a line formed in a substrate of sheet material that is predisposed to allow a tear to propagate there along. A "line of severance" and a "severance line" each may be a frangible or otherwise weakened line that is formed from one or more elements which include, but are not limited to, a single cut, a single half-cut, a single slit, an interrupted cut, a score line, an interrupted score line, a perforation or line of perforations, a line of short slits, a line of short half cuts, a combination of slits and score lines, and any combination of the aforementioned options.

It should be understood that the term "hinged connection" and the term "fold line" as use herein can each include one or more elements that are formed in the substrate of the blank including, but not limited to, a perforation, a line of perforations, a line of short slits, a line of half-cuts, a single half-cut, a cut line, an interrupted cut line, slits, scores, any combination thereof, and the like.

The one or more elements of a line of severance, hinged connection or fold line can be dimensioned and arranged to provide the desired functionality. For example, a perforation or line of perforations can be dimensioned or designed with degrees of weakness to define a fold line and/or a line of severance. The line of perforations can be designed to facilitate folding and resist breaking, to facilitate folding and facilitate breaking with more effort, or to facilitate breaking with little effort.

The phrase "in registry with" as used herein refers to alignment of two or more elements in an erected carton, such as two lines of severance formed respectively in two overlapping panels. Those elements in registry with each other may be aligned with each other in the direction of the thickness of the overlapping panels. For example, when one line of severance in a first panel is "in registry with" another line of severance in a second panel that is placed in an overlapping arrangement with the first panel, the one line of severance may extend along the other line of severance and may be aligned, in the direction of the thickness of the first and second panels, with the other line of severance.

The invention claimed is:

1. A carton for packaging one or more articles comprising a plurality of walls including a top wall, a first side wall, a second side wall, a first end wall, a second end wall and a bottom wall, the carton having an access device for accessing one or more articles in the carton, the access device comprising a detachable corner defined by a plurality of primary lines of severance which extend across the first side wall, the second side wall, the first end wall and the top wall such that the detachable corner is formed from respective detachable portions of the first side wall, the second side wall, the first end wall and the top wall, wherein the access device comprises at least one cut line which separates at least two of the primary lines of severance in at least one of the first and second side walls so as to control tearing of the primary lines of severance, wherein the access device further comprises a minor line of severance which extends from an intermediate portion of the at least one cut line.

2. The carton according to claim 1 wherein the at least one cut line comprises first and second end portions which are shaped to return towards the at least two of the primary lines of severance for mitigating against propagation of tears away from the primary lines of severance in the at least one of the first and second side walls.

3. The carton according to claim 2 wherein the at least two of the primary lines of severance in the at least one of the first and second side walls extend from the first end portion of the at least one cut line in a first direction and from the second end portion of the at least one cut line in a second direction.

4. The carton according to claim 3 wherein the minor line of severance extends from the intermediate portion of the at least one cut line in a third direction.

5. The carton according to claim 1 wherein the at least one cut line comprises a cut line in each of the first and second side walls, each of the cut lines separates the at least two of the primary lines of severance in a respective one of the first and second side walls to control tearing of the primary lines of severance, the access device further comprising a fold line extending transversely across the detachable portion of the top wall for enabling folding of the detachable corner when in a partially detached condition, a first minor line of severance defined in the detachable portion of the first side wall extending between the cut line in the first side wall and a first end of the fold line, and a second minor line of severance defined in the detachable portion of the second side wall extending between the cut line in the second side wall and a second end of the fold line, the first and second minor lines of severance being arranged contiguously with the fold line.

6. The carton according to claim 5 wherein the access device further comprises a tear initiation device which comprises a tab defined at least in part by at least one of the primary lines of severance, and wherein the tab is hinged to the detachable corner by a fold line.

7. A blank for forming a carton, the blank comprising a plurality of panels including a top wall, a first side wall, a second side wall, a first end wall, a second end wall and a bottom wall, the blank having an access device for accessing one or more articles in the carton, the access device comprising a detachable corner defined by a plurality of primary lines of severance which extend across the first side wall, the second side wall, the first end wall and the top wall such that the detachable corner is formed from respective detachable portions of the first side wall, the second side wall, the first end wall and the top wall, wherein the access device comprises at least one cut line which separates at least two of the primary lines of severance in at least one of the first and second side walls so as to control tearing of the primary lines of severance, wherein the access device further comprises a minor line of severance which extends from an intermediate portion of the at least one cut line.

8. The blank according to claim 7 wherein the access device further comprises a tear initiation device for facilitating initiation of a tear developing along the primary lines of severance for removal of the detachable corner; the primary lines of severance include a tear completion point where the tear stops developing when the detachable corner is fully separated from the carton, and the at least one cut line is located along the primary lines of severance between the tear initiation device and the tear completion point, the at least one cut line being spaced apart from either one of the tear initiation device and the tear completion point.

9. The blank according to claim 7 wherein the at least one cut line comprises a cut line in each of the first and second side walls, each of the cut lines separates at least two of the primary lines of severance in a respective one of the first and second side walls to control tearing of the primary lines of severance, the access device further comprising a fold line extending transversely across the detachable portion of the top wall for enabling folding of the detachable corner when in a partially detached condition, a first minor line of severance defined in the detachable portion of the first side wall extending between the cut line in the first side wall and a first end of the fold line and a second minor line of severance defined in the detachable portion of the second side wall extending between the cut line in the second side wall and a second end of the fold line, the first and second minor lines of severance being arranged contiguously with the fold line.

10. A carton for packaging one of more articles comprising a plurality of walls including a top wall, a first side wall, a second side wall, a first end wall, a second end wall and a bottom wall, the carton having an access device for accessing one or more articles in the carton, the access device comprising a detachable corner defined by a plurality of primary lines of severance which extend across the first side wall, the second side wall, the first end wall and the top wall such that the detachable corner is formed from respective detachable portions of the first side wall, the second side wall, the first end wall and the top wall, wherein the access device comprises at least one aperture which separates at least two of the primary lines of severance in at least one of the first and second side walls so as to control tearing of the primary lines of severance, wherein the access device comprises a minor line of severance which extends from a side edge of the at least one aperture.

11. The carton according to claim 10 wherein said at least one aperture is substantially oval in shape, the aperture having a longitudinal axis which is substantially aligned with the at least two of the primary lines of severance.

12. The carton according to claim 11 wherein the longitudinal axis extends between a first end of said at least one aperture and a second end of said at least one aperture wherein the at least two of the primary lines of severance extend from the first end in a first direction and from the second end in a second direction.

13. The carton according to claim 12 wherein the minor line of severance extends from the side edge of the at least one aperture in a third direction.

14. The carton according to claim 10 wherein the access device comprises a tear initiation device for facilitating initiation of tear developing along the primary lines of severance for removal of the detachable corner; the primary lines of severance include a tear completion point where the tear stops developing when the corner portion is fully separated from the carton, and the at least one aperture is located along the primary lines of severance between the tear initiation device and the tear completion point, the at least one aperture being spaced apart from either one of the tear initiation device and the tear completion point.

15. The carton according to claim 10 wherein said at least one aperture is substantially triangular in shape.

16. The carton according to claim 15 wherein the at least two of the primary lines of severance extend from the first corner of the at least one aperture in a first direction and from the second corner of the at least one aperture in a second direction.

17. The carton according to claim 16 wherein the minor line of severance extends from a third corner of the at least one aperture in a third direction.

* * * * *